US006558891B2

(12) United States Patent
Takada et al.

(10) Patent No.: US 6,558,891 B2
(45) Date of Patent: May 6, 2003

(54) SILVER HALIDE EMULSION

(75) Inventors: Hiroshi Takada, Tokyo (JP); Katsuhiko Heki, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/948,079

(22) Filed: Sep. 6, 2001

(65) Prior Publication Data

US 2002/0061481 A1 May 23, 2002

(30) Foreign Application Priority Data

Sep. 18, 2000 (JP) ..... 281851/2000

(51) Int. Cl.[7] ..... G03C 1/005; G03C 1/494

(52) U.S. Cl. ..... 430/567; 430/569; 430/599; 430/604; 430/605

(58) Field of Search ..... 430/567, 569, 430/599, 604, 605

(56) References Cited

U.S. PATENT DOCUMENTS 5,156,946 A * 10/1992 Nagaoka et al. ..... 430/567
5,650,266 A * 7/1997 Taguchi et al. ..... 430/567
5,728,515 A * 3/1998 Irving et al. ..... 430/567
6,280,920 B1 * 8/2001 Maruyama et al. ..... 430/567

* cited by examiner

*Primary Examiner*—Geraldine Letscher
(74) *Attorney, Agent, or Firm*—Frishauf, Holtz, Goodman & Chick, P.C.

(57) ABSTRACT

A silver halide emulsion is disclosed, comprising tabular silver halide grains having an average iodide content of 3 to 15 mol % and comprising silver halide phases differing in halide composition, at least 50% of the total projected area of the tabular silver halide grains being accounted for by grains having an aspect ratio of not less than 12, wherein the first silver halide phase (A) has an average iodide content of not more than 3 mol % and accounting for 50 to 85% of total silver, the second phase (B) locating outside the phase (A), having an average iodide content of 8 to 25 mol % and accounting for 10 to 35% of total silver, and the third outermost phase having an average iodide content of not more than 4 mol % 0.5 to 15% of total silver.

11 Claims, No Drawings

SILVER HALIDE EMULSION

FIELD OF THE INVENTION

The present invention relates to a silver halide emulsion, a preparation method of the silver halide emulsion and a silver halide photographic material by use of the silver halide emulsion.

BACKGROUND OF THE INVENTION

Silver halide photographic materials (hereinafter, also referred to as photographic materials) are said to be a mature product having extremely high completeness. On the other hand, various enhanced performance is still required, such as enhanced sensitivity, superior image quality and minimized variation in performance after storage. Further, enhancement of suitability for rapid access by accelerating progression of development is also required and required levels thereof recently have become higher. Specifically with regard to enhancement of sensitivity, to maintain superiority of silver halide photographic materials over recent technical progress of digital cameras, further enhanced sensitivity compatible with storage stability is desired, while fogging is maintained at low levels.

To achieve further enhanced sensitivity and superior image quality, a technique for enhancing the ratio of sensitivity/grain size per silver halide grain has been explored in silver halide emulsions (hereinafter, also referred to as emulsions). As is commonly known, silver halide grains contained in a silver halide emulsion have various grain shapes, such as cubic, octahedral, or tetradecahedral, regular crystal silver halide grains, tabular silver halide grains having a single twin plane or plural parallel twin planes, and tetrapod-like or needle-like silver halide grains having non-parallel twin planes. Specifically, tabular silver halide grains (hereinafter, also referred to as tabular grains) are supposed to have the following advantages of photographic performance.

1. The ratio of grain surface area to grain volume (hereinafter, denoted as specific surface area) is relatively large, thereby causing a relatively large amount of a sensitizing dye to be adsorbed onto the grain surface, leading to enhanced spectral sensitivity relative to inherent sensitivity.

2. When tabular grain emulsion is coated and dried, tabular grains are arranged parallel to the surface of the support, thereby reducing the coating layer thickness and leading to enhanced sharpness of the photographic material.

3. Light scattering by silver halide grains is reduced, resulting in images having enhanced resolution.

4. Sensitivity to blue light (inherent sensitivity) is relatively low, so that in cases where a green-sensitive layer or red-sensitive layer is concurrently included, the density of a yellow filter layer can be decreased or the yellow filter can be removed from the photographic material.

5. A given level of sensitivity can be achieved by a low silver coverage relative to conventional grains, resulting in an enhanced sensitivity/graininess ratio and superior resistance to natural radiation.

Prior arts concerning tabular grains, specifically concerning manufacturing methods and techniques for usage thereof are described in, for example, U.S. Pat. Nos. 4,434,226, 4,439,520, 4,414,310, 4433,048, 4,414,306, 4,459,353; JP-B No. 4-36347, 5-16015, 6-44132 (hereinafter, the term, JP-B refers to published Japanese Patent); JP-A No. 6-43605, 6-43606, 6-214331, 6-222488, 6-230493 and 6-258745 (hereinafter, the term, JP-A refers to unexamined, published Japanese Patent Application).

To effectuate the foregoing advantages of the tabular grains, it is effective to employ tabular grains having relatively high aspect ratio. As is known in the art, increasing the iodide content makes it more difficult to prepare tabular grains having a high aspect ratio, so that most of tabular grains prepared by the foregoing prior arts were silver bromide or relatively low iodide silver iodobromide. However, low iodide silver halide grains exhibit relatively high development activity, and in addition thereto, high aspect ratio tabular grains further promote development, due to their grain shape factors. As a result, deterioration in graininess or influence by natural radiation easily occurs, making it difficult for tabular grains having a relative high aspect ratio to effectuate their inherent advantages. Further, tabular grains having a relatively high aspect ratio tend to increase fluctuation in grain size, making it difficult to optimize chemical sensitization or spectral sensitization and resulting in reduction in contrast or color density.

JP-A No. 6-230491 discloses tabular grains having an iodide content in the fringe portions of 1.5 to 50 times that in the central portion of the grain and an aspect ratio of 8 to 100. In this technique, however, allowing a high iodide phase to be arranged in the fringe portions led to lowering suitability for chemical sensitization, resulting in reduction in sensitivity and contrast. JP-A No. 6-235988 discloses tabular grains having a multiple structure comprising an inner shell, an intermediate shell containing relative high iodide and an outermost shell, having an aspect ratio of 3 to 100. However, it was proved that the relatively low iodide outermost shell external to the intermediate shell accounted for a relatively high fraction of the grain produced problems such that accelerated development due to tabular grains having a high aspect ratio caused deteriorated graininess. In view of the foregoing, advantages achievable by tabular grains having a relatively high aspect ratio could not be effectuated.

In general, tabular grains are formed by a process comprising the stages of nucleation, ripening and growth. It is substantially infeasible to selectively form tabular nucleus grains alone in the nucleation stage, so that grains other than tabular nucleus grains need to be allowed to disappear in the ripening stage. Thus, the nucleation and ripening stages largely affect grain size homogeneity or aspect ratio of the tabular grains.

JP-A No. 6-230491 and 6-230493 describe a preparation method of tabular grains having a relatively high aspect ration, with attention given in the nucleation stage, in which low molecular weight gelatin is used in the nucleation stage, and nucleation time "t" (sec) and temperature "T" (° C.) within the reaction vessel at the nucleation stage satisfy the following relationship: $1<t<-T+90$. In this disclosure, however, although the nucleation temperature is defined as 20 to 60° C., and preferably 30 to 60° C., nothing is taught therein with respect to nucleation at lower temperature of less than 20° C.

As disclosed in JP-A Nos. 63-11928, 1-131541, 2-838 and 2-28638, it is commonly known that the use of silver halide solvents such as ammonia and thioethers in the ripening stage enhances monodispersibility of tabular grains. Although this technique is effective for preparation of tabular grains having a relatively low aspect ratio, the use of such silver halide solvents increases the thickness of tabular nucleus grains so that this technique is taught not to be applicable in the preparation of relatively high aspect ratio tabular grains. In cases when silver halide solvents are not used in the ripening stage, it becomes difficult to allow twinned nuclei having non-parallel twin planes to be disappeared. As a result, it was proved that in a silver halide emulsion obtained by the foregoing technique were concurrently present high aspect ratio-having tabular grains and non-parallel-twinned crystal grains, leading to increased fogging and deteriorated graininess caused by such non-parallel-twinned crystal grains. Accordingly, technical development is urgently desired.

SUMMARY OF THE INVENTION

In view of the foregoing problems, the present invention was achieved. Thus, it is an object of the invention to provide a silver halide emulsion exhibiting enhanced relationship between sensitivity and fog density, a superior graininess, improved radiation resistance and improvements in contrast and color forming property, and silver halide photographic material by use of the emulsion. In addition thereto, it is an object of the invention to provide a preparation method of a tabular silver halide grain emulsion having a relatively high aspect ratio.

The above objects can be accomplished by the following constitutions:

A silver halide emulsion comprising a dispersing medium and tabular silver halide grains having an average overall iodide content of 3 to 15 mol % and comprising silver halide phases, at least 50% of the total projected area of the tabular silver halide grains being accounted for by grains having an aspect ratio of not less than 12, wherein a first of the silver halide phases is an internal phase (A) having an average iodide content of not more than 3 mol % and accounting for 50 to 85% of total silver, a second of the silver halide phases is a phase (B) locating outside the phase (A), having an average iodide content of 8 to 25 mol % and accounting for 10 to 35% of total silver, and a third of the silver phases is an outermost phase having an average iodide content of not more than 4 mol % and accounting for 0.5 to 15% of total silver.

Preferred Embodiments of the Invention are as Follows 1. a silver halide emulsion, wherein the silver halide emulsion comprises a dispersing medium and tabular silver halide grains having an average iodide content of 3 to 15 mol %; the tabular silver halide grains comprising a phase (A), a phase (B) outside the phase (A) and an outermost phase within the grain, as defined below; and at least 50% of the total projected area of the tabular silver halide grains being accounted for by tabular grains having an aspect ratio of not less than 12;

a phase (A) having an average iodide content of not more than 3 mol % and accounting for 50 to 85% of total silver, a phase (B) having an average iodide content of 8 to 25 mol % and accounting for 10 to 35% of total silver, and an outermost phase having an average iodide content of not more than 4 mol % and accounting for 0.5 to 15% of total silver;

2. a silver halide emulsion, wherein the silver halide emulsion comprises a dispersing medium and tabular silver halide grains, the tabular silver halide grains comprising a phase (A), a phase (B) outside the phase (A) and an outermost phase within the grain, as defined above; at least 50% by number of the silver halide grains exhibiting an adjacent edge ratio of 0.5 to 2.0; and at least 50% of the total projected area of the tabular silver halide grains being accounted for by tabular grains having an aspect ratio of not less than 12;

3. a silver halide emulsion, wherein the silver halide emulsion comprises tabular silver halide grains and a dispersing medium, the tabular silver halide grains comprising a phase (A), phase (B) outside the phase (A) and an outermost phase within the grain, as defined above; at least 50% by number of the silver halide grains having at least 5 dislocation lines in edge portions of the grain; and at least 50% of the total projected area of the tabular silver halide grains being accounted for by tabular grains having an aspect ratio of not less than 12;

4. a silver halide emulsion, wherein the silver halide emulsion comprises a dispersing medium and tabular silver halide grains, the tabular silver halide grains comprising a phase (A), a phase (B) outside the phase (A) and an outermost phase within the grain, as defined above; a ratio of a grain thickness to a thickness of the phase (B) in the section vertical to a major face being less than 5; and at least 50% of the total projected area of the tabular silver halide grains being accounted for by grains having an aspect ratio of not less than 12;

5. a silver halide emulsion, wherein the silver halide emulsion comprises a dispersing medium and tabular silver halide grains having an average surface iodide content of 6 to 14 mol %, the tabular silver halide grains comprising a phase (A), a phase (B) outside the phase (A) and an outermost phase within the grain, as defined above; the tabular silver halide grains having an average spacing between twin planes of not more than 0.01 $\mu$m; and at least 50% of the total projected area of the tabular silver halide grains being accounted for by grains having an aspect ratio of not less than 12;

6. a silver halide emulsion, wherein the silver halide emulsion comprises a dispersing medium and tabular silver halide grains, said tabular silver halide grains comprising phase (A), a phase (B) outside the phase (A) and an outermost phase within the grain, as defined above; the tabular silver halide grains having an average iodide content in the vicinity of corners, which is lower than an average surface iodide content; and at least 50% of the total projected area of the tabular silver halide grains being accounted for by grains having an aspect ratio of not less than 12;

7. a silver halide emulsion, wherein the silver halide emulsion comprises tabular silver halide grains and a dispersing medium, the tabular silver halide grains comprising a phase (A), a phase (B) outside the phase (A) and an outermost phase within the grain, as defined above; at least 50% by number of the tabular grains having dislocation lines in the peripheral region of major faces and the region surrounded by the dislocation lines being in a circular form; and at least 50% of the total projected area of the tabular silver halide grains being accounted for by grains having an aspect ratio of not less than 12;

8. a silver halide emulsion, wherein the silver halide emulsion comprises tabular silver halide grains and a dispersing medium, the tabular silver halide grains being formed in the presence of a compound having a group capable of releasing an iodide ion and represented by the following formula (I); and at least 50% of the total projected area of the tabular silver halide grains being accounted for by tabular grains having an aspect ratio of not less than 12:

Formula (I)

$$\{X\text{-}(L_1)_{n1}\}_{n2}\text{-}L_2\text{-}(SOL)_m$$

wherein X represents an iodine atom; $L_1$ and $L_2$ each represent a bivalent linkage group; SOL represents an aqueous solubility-enhancing group; n1 is 0 or 1; m and n2 are each an integer of 1 to 4;

9. a silver halide emulsion, wherein the silver halide emulsion comprises tabular silver halide grains and a dispersing medium, the tabular silver halide grains comprising a phase (A), a phase (B) outside the phase (A) and an outermost phase within the grain, as defined above; the tabular silver halide grains being formed in the presence of a compound having a group capable of releasing an iodide ion and represented by the formula (I) defined above; and at least 50% of the total projected area of the tabular silver halide grains being accounted for by tabular grains having an aspect ratio of not less than 12;

10. a silver halide emulsion, wherein the silver halide emulsion comprises tabular silver halide grains and a dispersing medium, said tabular silver halide grains comprising a phase (A), a phase (B) outside the phase (A) and an outermost phase within the grain, as defined above; at least one of the phase (A), phase (B) and outermost phase containing a compound represented by the formula (II); and at least 50% of the total projected area of the tabular silver halide grains being accounted for by grains having an aspect ratio of not less than 12:

formula (II)

$$[ML_6]^n$$

wherein M represents a filled frontier orbital polyvalent metal ion; $L_6$ represents six coordinated complex ligands; and n represents -, 2-, 3- or 4-;

11. a silver halide emulsion, wherein the silver halide emulsion comprises tabular silver halide grains and a dispersing medium, having been prepared by a process comprising a nucleation step, ripening step and growth step; an average iodide content of tabular grains in the nucleation step being not more than 2 mol % and an average iodide content of the prepared emulsion being 5 to 12 mol %; and at least 50% of the total projected area of the tabular silver halide grains being accounted for by grains having an aspect ratio of not less than 12;

12. a silver halide emulsion, wherein the silver halide emulsion comprises tabular silver halide grains and a dispersing medium, said tabular silver halide grains comprising a phase (A), a phase (B) outside the phase (A) and an outermost phase within the grain, as defined above; at least 50% of the total projected area of the tabular silver halide grains being accounted for by grains having an aspect ratio of not less than 12; at least 10% by weight of the dispersing medium is a chemically modified gelatin;

13. the silver halide emulsion of any one of 1 through 12, wherein at least 50% of the total projected area of the tabular silver halide grains being accounted for by tabular grains having an aspect ratio of not less than 15;

14. the silver halide emulsion of any one of 1 through 13, wherein a coefficient of variation of grain size of tabular silver halide grains contained in the silver halide emulsion is not more than 25%;

15. the silver halide emulsion of any one of 1 through 14, wherein tabular silver halide grains contained in the silver halide emulsion substantially are silver iodobromide;

16. the silver halide emulsion of any one of 1 through 15, wherein concentration of the silver halide emulsion is performed by means of ultrafiltration during at least a part of the growth step of silver halide grains;

17. a preparation method of a silver halide emulsion, wherein at least 50% of the total grain projected area is accounted for by tabular grains having an aspect ratio of not less than 12, the method comprising the steps of nucleation, ripening and growth, wherein the nucleation is performed at a pBr of 1.8 to 2.8, a pH of 1.5 to 3.0 and a temperature of 5 to 20° C. in the presence of a low molecular weight gelatin having an average molecular weight of not more than 30,000;

18. a preparation method of a silver halide emulsion, wherein at least 50% of the total grain projected area is accounted for by tabular grains having an aspect ratio of not less than 12, the method comprising the steps of nucleation, ripening and growth, wherein the nucleation is performed at a temperature of 5 to 20° C. in the presence of a low molecular weight gelatin having an average molecular weight of not more than 30,000 and at least a part of the ripening being performed in the presence of a silver halide solvent;

19. a preparation method of a silver halide emulsion, wherein at least 50% of the total grain projected area is accounted for by tabular grains having an aspect ratio of not less than 12, the method comprising the steps of nucleation, ripening and growth, wherein the nucleation is performed at a temperature of 5 to 20° C. in the presence of a low molecular weight gelatin having an average molecular weight of not more than 30,000 and at least a part of the ripening being performed at a pH of 7 to 12;

20. a preparation method of a silver halide emulsion, wherein at least 50% of the total grain projected area is accounted for by tabular grains having an aspect ratio of not less than 12, the method comprising the steps of nucleation, ripening and growth, wherein the nucleation is performed at a temperature of 5 to 20° C. in the presence of a low molecular weight gelatin having an average molecular weight of not more than 30,000 and at least a part of the ripening and growth is performed at a relatively high temperature having a difference of 40 to 70° C. from the nucleation;

21. a preparation method of a silver halide emulsion, wherein at least 50% of the total grain projected area is accounted for by tabular grains having an aspect ratio of not less than 12, the method comprising the steps of nucleation, ripening and growth, wherein the nucleation is performed at a temperature of 5 to 20° C. in the presence of a low molecular weight gelatin having an average molecular weight of not more than 30,000, the silver concentration of a reaction solution being $1\times10^{-3}$ to $1\times10^{-2}$ mol/l at the time the nucleation is completed;

22. a preparation method of a silver halide emulsion, wherein at least 50% of the total grain projected area is accounted for by tabular grains having an aspect ratio of not less than 12, the tabular silver halide grains comprising a phase (A), a phase (B) outside the phase (A) and an outermost phase within the grain, as defined above, the method comprising the step of preparing the emulsion by the use of a seed grain emulsion, wherein the silver concentration of an aqueous solution containing the seed grain emulsion in a reaction vessel is $1\times10^{-3}$ to $1\times10^{-2}$ mol/l before starting a grain growth step;

23. a preparation method of a silver halide emulsion, wherein at least 50% of the total grain projected area is accounted for by tabular grains having an aspect ratio of not less than 12, the method comprising the steps of nucleation, ripening and growth, wherein the nucleation is performed at a temperature of 5 to 20° C. in the presence of a low molecular weight gelatin having a mean molecular weight of not more than 30,000, and at least a part of the growth being performed in the presence of the compound represented by formula (I) defined above;

24. a preparation method of a silver halide emulsion, wherein at least 50% of the total grain projected area is accounted for by tabular grains having an aspect ratio of not less than 12, the tabular silver halide grains comprising the phase (A) within the grain, as defined above and phase (B) defined above being formed outside the phase (A) so that an average aspect ratio after completion of grain formation is smaller than an average aspect ratio after completion of phase (A) formation;

25. the preparation method of a silver halide emulsion of any one of 17 through 24, wherein concentration of the silver halide emulsion is performed by means of ultrafiltration;
26. a silver halide photographic light-sensitive material comprising on one side of a support at least a light-sensitive layer, characterized in that the light-sensitive layer comprises a silver halide emulsion of any one of claims 1 through 16; and
27. a silver halide photographic light-sensitive material comprising on one side of a support at least a light-sensitive layer, characterized in that the light-sensitive layer comprises a silver halide emulsion prepared according to the method of any one of claims 17 through 25.

DETAILED DESCRIPTION OF THE INVENTION

Silver halide emulsions according to the invention comprise a dispersing medium and tabular silver halide grains. The dispersing medium refers to a compound capable of acting as a protective colloid for silver halide grains and it is preferred to allow the dispersing medium to be present in the process of preparation of silver halide emulsions of from nucleation to completion of grain growth. Preferred dispersing mediums used in the invention are gelatin and hydrophilic colloids. Examples of preferred gelatin usable in the invention include alkali-processed or acid-processed gelatin having a molecular weight of 100,000 or so, oxidized gelatin, and enzyme-treated gelatin described in Bull. Soc. Sci. Photo. Japan No. 16, page 30 (1966). Examples of hydrophilic colloid include gelatin derivatives, graft polymers of gelatin with other polymers, proteins such as albumin or casein, cellulose derivatives such as hydroxyethyl cellulose, carboxymethyl cellulose, cellulose sulfuric acid esters, saccharide derivatives such as sodium alginate and starch derivatives, and synthetic hydrophilic polymeric material such as polyvinyl alcohol, polyvinyl alcohol partial acetal, poly-N-vinyl pyrrolidine, polyacrylic acid, polymethacrylic acid, polyacrylamide, polyvinyl imidazole, polyvinyl pyrazolo and their copolymer.

In the nucleation stage of silver halide grain formation are peferably employed oxidized gelatin, low molecular weight gelatin having molecular weights of 10,000 to 500,000 and oxidized, low molecular weight gelatin. In the preparation method of silver halide emulsions relating to the invention, low molecular weight gelatin having an average molecular weight of not more than 30,000 is employed and the use of oxidized, low molecular weight gelatin is preferred, of which an average molecular weight is more preferably 10,000 to 25,000.

In the invention, chemically modified gelatin is preferably used in the silver halide grain growth stage or desalting stage thereof. Chemically modified gelatin preferably accounts for at least 10% by weight, more preferably at least 30% by weight, and still more preferably at least 50% by weight of a dispersing medium contained in a silver halide emulsion after completion of the preparation thereof. Chemically modified gelatins usable in the invention include, for example, N-substituted amino group containing gelatin described in JP-A 5-72658, 9-197595 and 9-251193.

Tabular silver halide grains are crystallographically classified as twinned crystal. The twinned crystal refers to crystal having at least one twin plane within the crystal grain. Morphological classification of silver halide twinned crystals are detailed in Klein & Moisar, Photographishe Korrespondenz, vol. 99, page 99 and ibid vol. 100, page 57. Tabular silver halide grains relating to the invention preferably at least two parallel twin planes within the grain. These twin planes exist in parallel to the face having the maximum area among faces forming surfaces of the grain (which is also referred to as major face). In the invention, grains having two parallel tin planes are preferred, and tabular grains having two parallel twin planes preferably account for at least 50%, and more preferably at least 80% of the total grain projected area. The tabular silver halide grains relating to the invention are referred to as grains having an aspect ratio or 2 or more.

In one embodiment of the invention, an average value of spacing between twin planes of the grains (i.e., a mean spacing between twin planes) is preferably not more than 0.01 $\mu$m, and more preferably 0.009 to 0.003 $\mu$m to allow high aspect ratio to be consistent with homogeneity in grain size. The spacing between twin planes refers to a distance between two parallel twin planes and in cases where three or more twin planes exist, it refers to a distance farthest from each other, i.e., a maximum value among distances between twin planes. The twin plane can be observed using a transmission electron micrograph according to the following procedure. Sample is prepared by coating a tabular silver halide grain emulsion on a substrate so that the major faces of tabular grains are arranged parallel to the substrate. Using a diamond cutter, the thus prepared sample is sliced vertically to the substrate to obtain slices with a thickness of ca. 0.1 $\mu$m. Observing the thus obtained slices by the transmission electron microscope, the presence/absence of a twin plane, the position thereof and the spacing between twin planes can be determined. Measurement of a spacing between twin planes is made for at least 100 grains a nd an average value thereof is defined as a spacing between twin plane in the invention.

A silver halide emulsion relating to the invention comprises tabular grains and tabular grains having an aspect ratio of 12 or more accounts for at least 50% of the total grain projected area and tabular grains having an aspect ratio of not less than 12 and not more than 100 preferably accounts for at least 80% of the total grain projected area. In one preferred embodiment of the invention, at least 50% of the total grain projected area is accounted for by tabular silver halide grains having an aspect ratio of not less than 15, and more preferably tabular grains having an aspect ratio of not less than 15 and not more than 50. Tabular rains having an aspect ratio of less than 12 cannot display advantages based on the grain shape, and in tabular grains having an aspect ratio of more than 100, development is exceedingly accelerated, often resulting in deteriorated graininess and markedly deteriorated pressure resistance.

In the invention, the aspect ratio refers to a ratio of grain diameter to grain thickness (i.e., aspect ratio=grain diameter/grain thickness). When a grain is projected vertically to the major faces of the grain, the grain diameter is a diameter of a circle having an area equivalent to the grain projected area (equivalent circular diameter). The grain diameter, thickness and aspect ratio of tabular grains can be determined according to the following procedure (replicating technique). A coat sample is prepared by coating a silver halide emulsion containing latex balls, as an internal standard, having a given diameter on the substrate so that the major faces of the grains are oriented parallel to the substrate. After subjecting the sample to shadowing from a given angle by carbon vacuum evaporation, a replica sample is prepared by the conventional replica method. Electron micrographs of the thus prepared sample are taken and the projected area and thickness of each grain can be determined using an image processing apparatus. In this case, the grain projected area can be determined from the projected area of the internal standard, and the grain thickness can also be determined shadow lengths of the internal standard and the grain.

As is well known in the art, enhancement of homogeneity in size, i.e., mono-dispersibility of silver halide grains is effective in enhancing sensitivity and image quality of silver halide photographic materials and tabular grains having higher aspect ratio lead to further improved results. Tabular grains used in the invention preferably have a coefficient of variation of grain size of not more than 25%, more preferably not more than 20%, and still more preferably not more than 15%. Homogeneity of grain thickness distribution of tabular grains is an important characteristic to improve sharpness. In one preferred embodiment of silver halide emulsions according to the invention, a coefficient of variation of grain thickness distribution of tabular grains is not more than 30%. The coefficient of variation of grain size or thickness distribution of tabular silver halide grains is a value defined as below. In this case, at least 500 grains selected at random from the silver halide emulsion are measured using a replicating technique with respect to grain size or thickness:

Coefficient of variation of grain size (%)=(standard deviation of grain size/average grain size)×100Coefficient of variation of grain thickness (%)=(standard deviation of grain thickness/average grain thickness)×100

Shapes of tabular grains include triangular, hexagonal and circular forms. Tabular silver halide grains relating to the invention are not specifically limited with respect to grain shape but at least 50% by number of tabular silver halide grains contained in the emulsion is preferably accounted for by tabular grains having an adjacent edge ratio of 0.5 to 2.0. U.S. Pat. No. 4,797,354 and JP-A No. 2-838 describe a process for preparing monodisperse hexagonal tabular grains having a relatively high tabularity. European Patent 514,742 describes a process of preparing tabular grains having a coefficient of variation of grain size distribution of less than 10%, by using polyalkyleneoxide block copolymer. These techniques are applicable to the preparation of silver halide emulsions relating to the invention.

In tabular rains, compatibility between sensitivity and graininess is one of important problems to be overcome. Specifically, high aspect ratio-having tabular grains often cause marked deterioration in graininess, producing troubles in practical use. It was contemplated by the inventors of the present invention that enhancement of sensitivity and improvement of graininess could be achieved by controlling developability of high aspect ratio-having tabular grains and as a result of their studies, it was found that desired high performance was achieved in tabular grains having a relatively high aspect ratio and a specific grain structure. Concurrently, it was unexpectedly found that increased fogging or deteriorated graininess caused by natural radiation during storage of photographic materials were improved.

In the silver halide emulsion relating to the invention, a phase (A) is located in the interior of high aspect ratio tabular silver halide grains, and a phase (B) and an outermost phase are further arranged outside the phase (A) within the grain, thereby enabling to display superior results. The phase (A) is an internal region having an average iodide content of not more than 3 mol % and preferably 0 to 2 mol % and accounting for 50 to 85%, and preferably 60 to 80% of total silver forming grains. Similarly, the phase (B) is a region arranged external to the phase (A), having an average iodide content of 8 to 25 mol %, and preferably 10 to 20 mol % and accounting for 10 to 35%, and preferably 15 to 30% of total silver forming grains. The outermost phase is a region arranged external to the phase (B) and in the outermost side of the tabular grain, having an average iodide content of not more than 4 mol %, and preferably 0 to 2 mol %, accounting for 0.5 to 15%, and preferably 2 to 10% of total silver forming grains.

In the tabular grain relating to the invention, the phase (A), phase (B) and the outermost phase may be arranged outwardly extending from the center of two major faces opposing to each other in the direction parallel to the major faces, but a structure in which the phase (A), phase (B) and outermost phase-1re arranged outwardly extending from the center in the direction vertical to the major faces or a structure in which after the phase (A) is formed, the phase (B) is arranged outwardly extending from the center in the directions parallel and vertical to the major faces and after the phase (B) is formed, the outermost phase is arranged outwardly extending from the center in the direction parallel to the major faces is preferable.

In one feature of the tabular grains of the invention, the ratio of grain thickness to a thickness of the phase (B) in the section vertical to the major faces (i.e., grain thickness/phase (B) thickness) is preferably less than 5, and more preferably 1 to 4. The thickness of the phase (B) (hereinafter, also denoted as phase (B) thickness) is defined as a thickness measured in the direction vertical to the central portion of the major faces of the tabular grain. The phase (B) thickness is defined as a sum of phase (B)s formed across the twin plane(s). The phase (B) thickness can be observed and determined using cross-sectional electron micrograph, based on discontinuity of iodide contents between the phase (A) and phase (B) or between the phase (B) and outermost phase.

The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while ensuring to not exert any pressure that causes dislocation in the grains, and are then placed on a mesh for electron microscopy. The sample is observed by transmission electron microscopy, while being cooled to prevent the grain from being damaged (e.g., printing-out) by the electron beam. Since electron beam penetration is hampered as the grain thickness increases, sharper observations are obtained when using an electron microscope of a high voltage type.

In tabular grains relating to the invention, the number of dislocation lines or their forms are optimally selected and at least 50% by number of the tabular grains preferably contain at least 5 dislocation lines in each edge of the grain. Further, at least 80% by number of the tabular grains preferably contain 5 to 100 dislocation lines, and more preferably 10 to 50 dislocation lines in each of edges constituting the major face.

In one preferred embodiment of the invention, at least 50% by number of the tabular grains contain dislocation lines in the peripheral region of the major face and the region surrounded by these dislocation lines is in a circular form. Herein, the peripheral region of the major face is a region of from the fringe of the major face to a length of 1/10 of a line (also denoted as line-1) connecting the fringe and the center of the major face. Thus, when line-1 is drawn from the center of the major face to the fringe of the major face, peripheral region of the major face is a region surrounded by the fringe of the major face and a line connecting a point, on the line-1, at a length of 1/10 of the line-1 from the fringe.

The method for introducing dislocation lines into the tabular grains is not specifically limited and examples thereof include double-jet addition of an aqueous iodide ion containing solution (such as an aqueous potassium iodide solution) and aqueous silver salt solution, addition of fine silver iodide grains, addition of an aqueous iodide ion containing solution alone, and the use of an iodide ion releasing agent described in JP-A 6-11781 and JP-A 11-271912. Applying the foregoing commonly known methods, dislocation as an origin of dislocation lines can be formed at the intended position. Of these methods, the double-jet addition of an aqueous iodide ion containing solution (such as an aqueous potassium iodide solution) and aqueous silver salt solution, addition of fine silver iodide grains, and the use of an iodide ion releasing agent are preferable. In one preferred embodiment of the invention, the tabular grains are preferably formed in the presence of a compound having a group capable of releasing an iodide ion and represented by the following formula (I):

formula (I)

$$\{X-(L_1)_{n1}\}_{n2}-L_2-(SOL)_m$$

wherein X represents an iodine atom; $L_1$ and $L_2$ each represent a bivalent linkage group; SOL represents an aqueous solubility-enhancing group; n1 is 0 or 1; m and n2 are each an integer of 1 to 4.

To add the compound having a group capable of releasing an iodide ion and represented by the following formula (I) in the process of emulsion making and/or in the process of preparation of photographic materials, the compound may be directly dispersed to be added, or may be dissolved in a solvent such as water, methanol, ethanol, or mixture thereof and added. Thus, commonly known methods for adding additives to silver halide emulsions or photographic materials are applicable. The compound represented by formula (I) is preferably added in an amount of $1\times10^{-7}$ to 30 mol %, and more preferably $1\times10^{-5}$ to 10 mol % per mol of silver halide. The amount of a released halide ion is preferably 0.001 to 30 mol %, and more preferably 0.01 to 10 mol % per mol of silver halide.

The compound represented by formula (I) may release all of iodide ions included in the compound or a part of the iodide ions may remain therein without being reacted. The compound represented by formula (I) may be used alone or in combination. As a compound represented by formula (I) may be employed a compound having a group promoting adsorption to silver halide and a group capable of releasing an iodide ion, as described in JP-A 11-95347.

The compound represented by formula (I) will be further described in detail. In formula (I), X is an iodine atom. The bivalent linkage group represented by $L_1$ is preferably an aliphatic group, an aromatic group, a heterocyclic group or a group obtained by the combination of any one of these foregoing groups with any one of —COO—, —OCO—, —$SO_2$—, —$SO_2O$—, —CON($R_4$)—, —N($R_4$)CO—, —CSN($R_4$)— and —N(R4)CS— (in which $R_4$ is a hydrogen atom, analkyl group or aryl group), more preferably a group obtained by the combination of a bivalent linkage group with any one of —COO—, —OCO—, $SO_2$—, —$SO_2O$—, —CON($R_4$)—, —N($R_4$)CO—, —CSN($R_4$)— and —N($R_4$)CS—, and still more preferably a group represented by formula (B), as described below; and n is 1 or 0, and preferably 1. $L_2$ is also a bivalent linkage group, preferably an aliphatic group, an aromatic group or a heterocyclic group, still more preferably an aromatic group, and specifically preferably a phenylene group.

In the formula, SOL is an aqueous solubility-enhancing group group, such as a carboxy group, sulfo group, hydroxy group or quaternary ammonium group. A sulfo group is specifically preferred. The carboxy or sulfo group preferably is in the form of a salt of an alkali metal (e.g., sodium, potassium), in terms of enhancing aqueous solubility. Further, m is an integer of 1 to 4, preferably 1 or 2, and more preferably 1.

$L_1$ in formula (I) is preferably represented by the following formula (B):

formula (B)

$$—C(R_1)(R_2)—CH(R_3)—EWG—$$

wherein $R_1$ through $R_3$ are each a substituent group. Examples of the substituent group include an alkyl group, aralkyl group, alkenyl group, alkynyl group, alkoxy group, aryl group, substituted amino group, ureido group, urethane group, aryloxy group, sulfamoyl group, carbamoyl group, alkyl- or aryl-thio group, alkyl- or aryl-sulfonyl group, alkyl- or aryl-sulfinyl group, hydroxy group, halogen atom, cyano group, sulfo group, aryloxycarbonyl group, alkoxycarbonyl group, acyloxy group, carbonamido group, sulfonamido group, carboxy group, phosphoric acid amido group, diacylamino group and imido group; and $R_1$ through $R_2$ are preferably a hydrogen $_3$ are preferably a hydrogen atom.

EWG is —COO—, —OCO—, —$SO_2$——$SO_2O$—, —CON($R_5$)—, —N($R_5$)CO—, —CSN($R_5$)—, —N($R_5$)CS—, —O—, —S—, —N ($R_5$)—, —CO—, —CS—, —COCO—, —$SO_2$N($R_5$)— OR —N($R_5$)$SO_2$—, in which $R_5$ is a hydrogen atom, an alkyl group, or an aryl group, and preferably a hydrogen atom Preferred examples of the compound of formula (I) are shown below, but are by no means limited to these.

ID-1

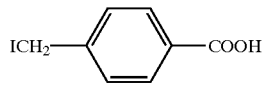

ID-2

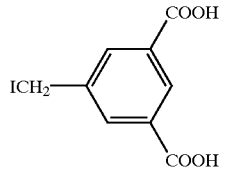

ID-3

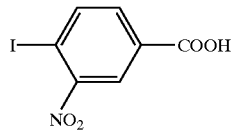

ID-4

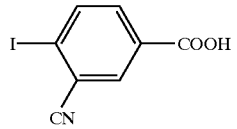

-continued
ID-5
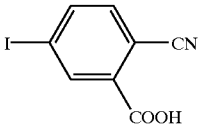
ID-6
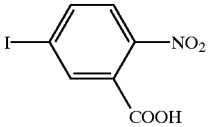
ID-7
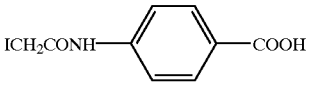
ID-8
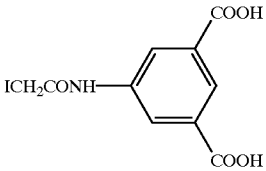
ID-9
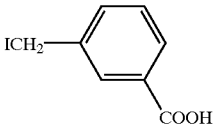
ID-10
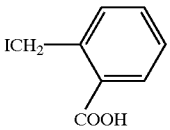
ID-11
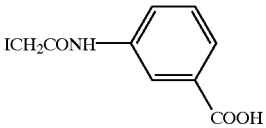
ID-12
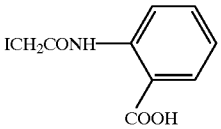
ID-13
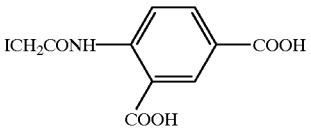
ID-14
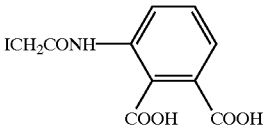
ID-15
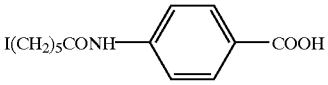
ID-16
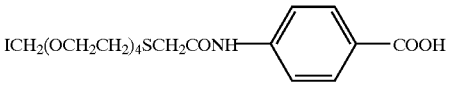
-continued
ID-17
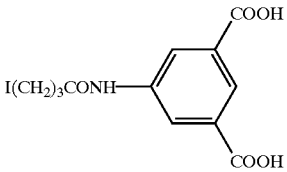
ID-18
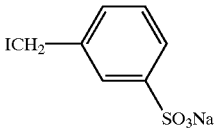
ID-19
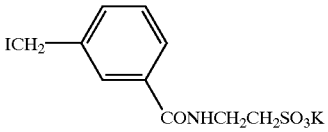
ID-20
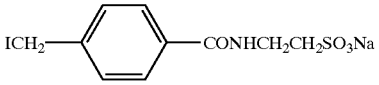
ID-21
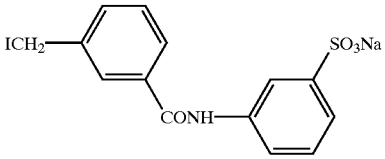
ID-22
$ICH_2CONHCH_2CH_2SO_3Na$
ID-23
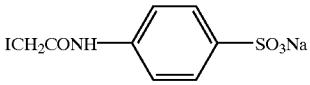
ID-24
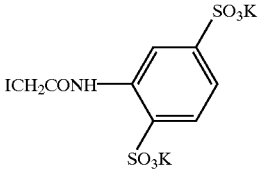
ID-25
$ICH_2CH_2SO_3Na$
ID-26
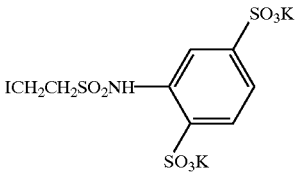
ID-27
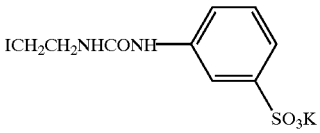
ID-28
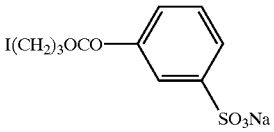

-continued
ID-29
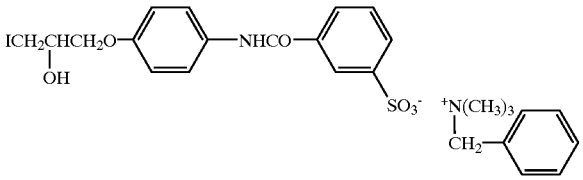
ID-30
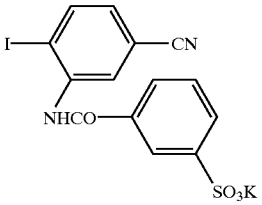
ID-31
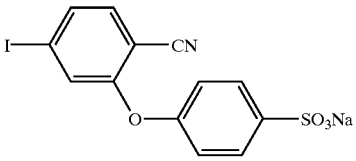
ID-32
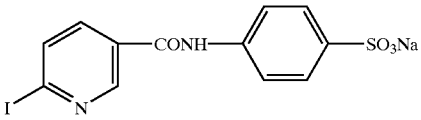
ID-33
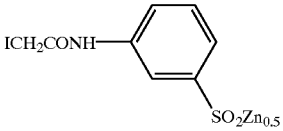
ID-34
$ICH_2CH_2OH$
ID-35
$I(CH_2)_3OH$
ID-36
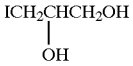
ID-37
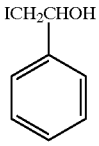
ID-38
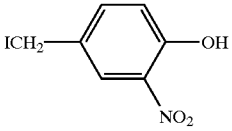
ID-39
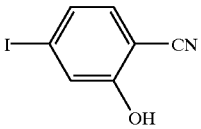
ID-40
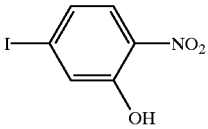
ID-41
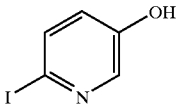
ID-42
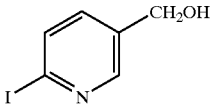
ID-43
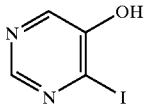
ID-44
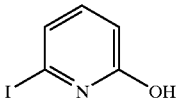
ID-45
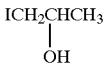
ID-46
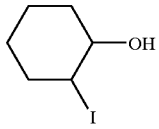
ID-47
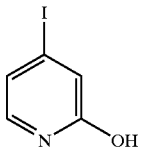
ID-48
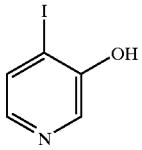
ID-49
$ICHCH_2\overset{+}{N}(CH_3)_3 \cdot CF_3SO_3^-$
ID-50
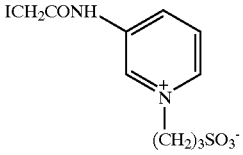
ID-51
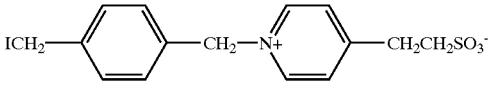
ID-52
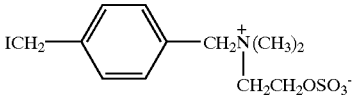
ID-53
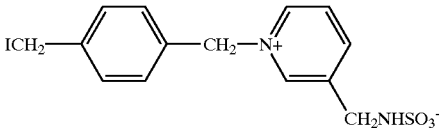

-continued
ID-54
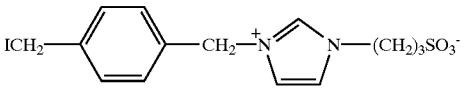
ID-55
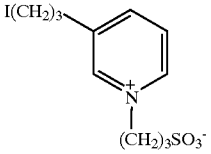
ID-56
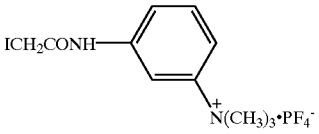
ID-57
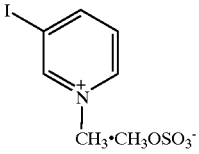
ID-58
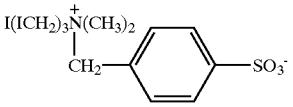
ID-59
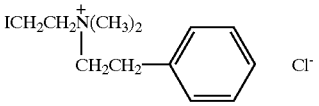
ID-60
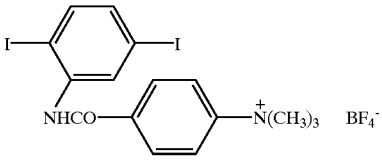
ID-61
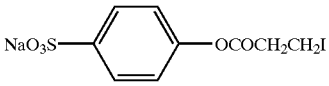
ID-62
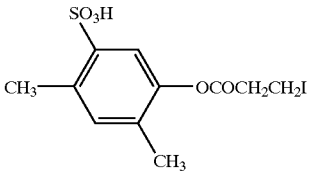
ID-63
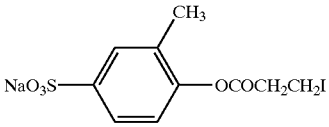
ID-64
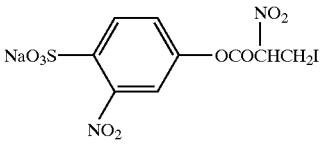
-continued
ID-65
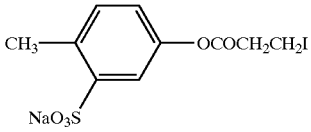
ID-66
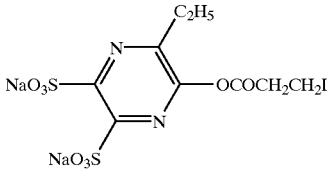
ID-67
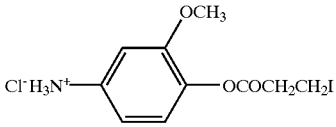
ID-68
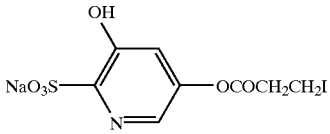
ID-69
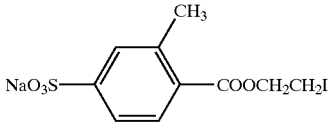
ID-70
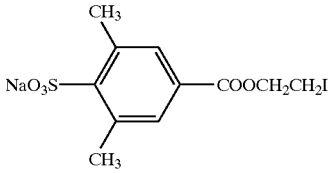
ID-71
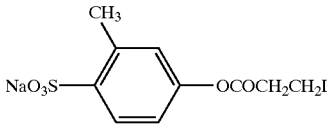
ID-72
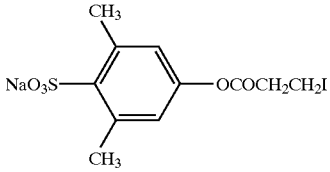
ID-73
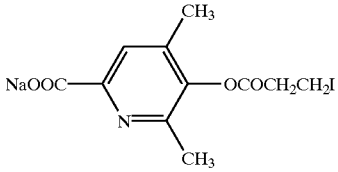
ID-74
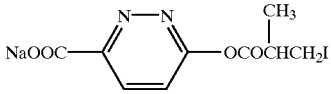

-continued
ID-75
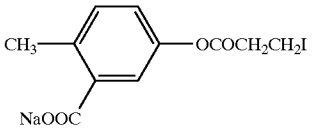
ID-76
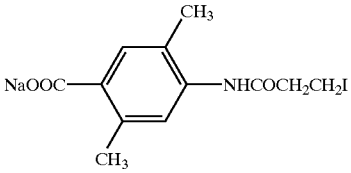
ID-77
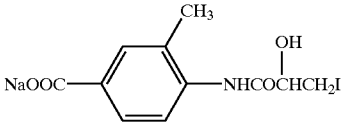
ID-78
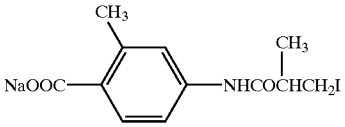
ID-79
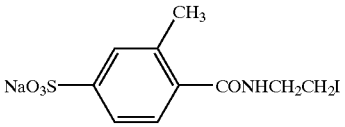
ID-80
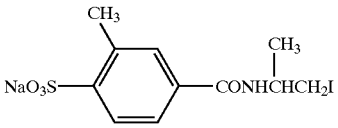
ID-81
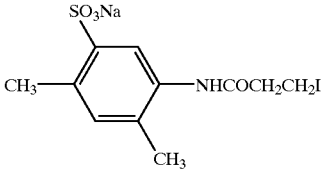
ID-82
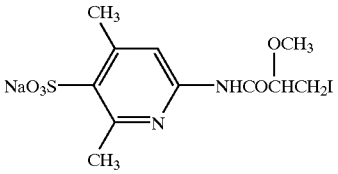
ID-83
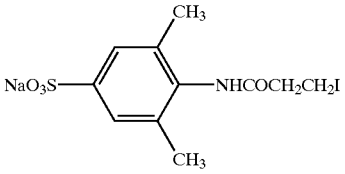
ID-84
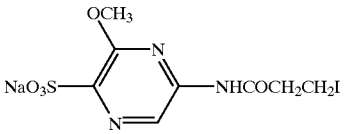
-continued
ID-85
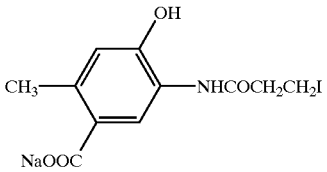
ID-86
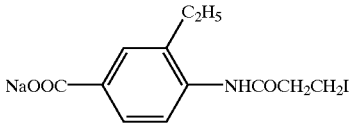
ID-87
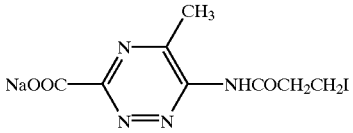
ID-88
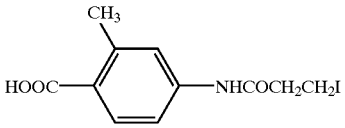
ID-89
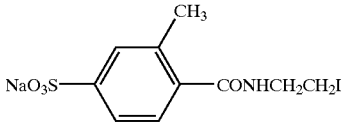
ID-90
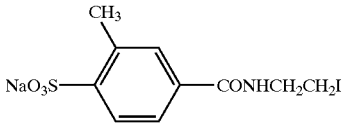
ID-91
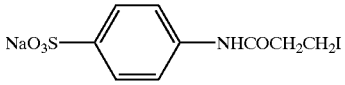
ID-92
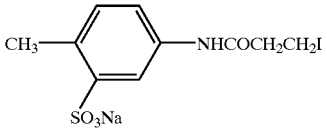
ID-93
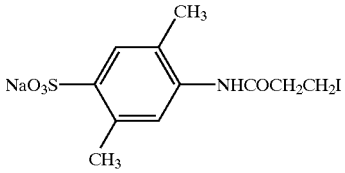
ID-94
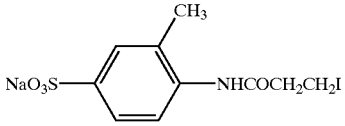
ID-95
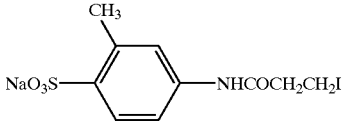

-continued

ID-96

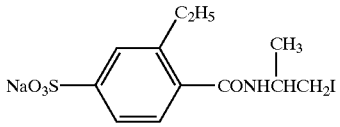

ID-97

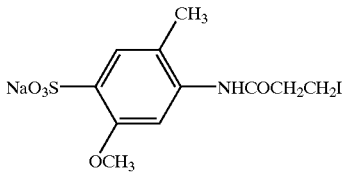

ID-98

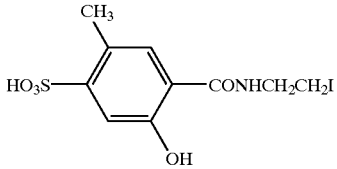

ID-99

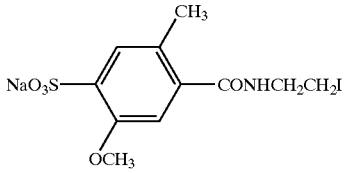

ID-100

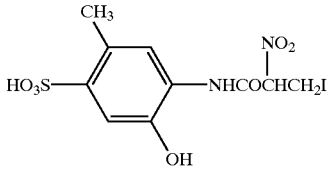

ID-101

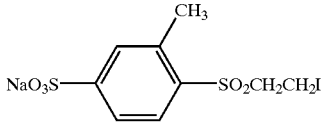

ID-102

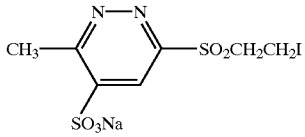

ID-103

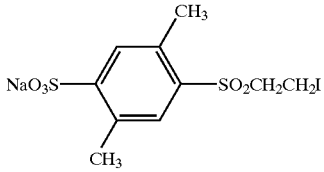

ID-104

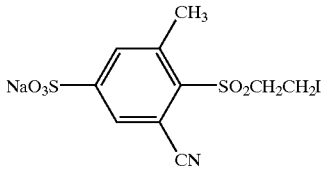

-continued

ID-105

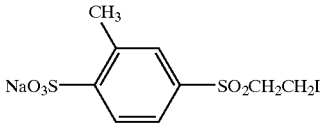

ID-106

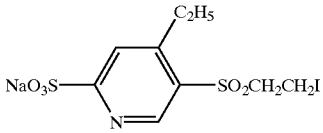

ID-107

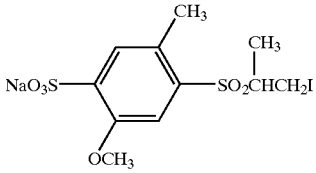

ID-108

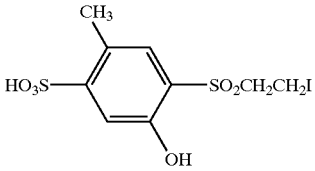

ID-109

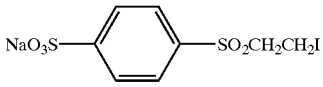

ID-110

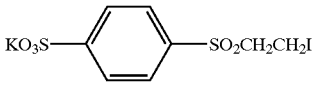

In the tabular grains relating to the invention, dislocation lines may optimally be introduced at any position, and is preferably introduced at the position between the foregoing phase (A) and phase (B) In such a case, from the view point of controlling developability, halide ions such as iodide ions which are added at the time of introducing dislocation lines deposit on silver halide grains to form a high iodide region, which is regarded as a part of the phase (B).

In one preferred embodiment of the silver halide emulsion relating to the invention, the average value of surface iodide contents of silver halide grains is 6 to 14 mol %, and more preferably 7 to 12 mol %. The average iodide content of a silver halide grain emulsion can be determined by the XPS method (i.e., X-ray Photoelectron Spectroscopy). Further, iodide contents of respective silver halide grains or the average iodide content of the whole silver halide emulsion grains can be determined by the EPMA method (i.e., Electron Probe Micro Analysis). In silver halide emulsions relating to the invention, the average iodide content is 3 to 15 mol %, and preferably 4to 12 mol %. The halide composition of silver halide grains relating to the invention is not specifically limited, except for the region defined in the invention, and in one embodiment of the invention, preferred silver halide grains of the invention are substantially comprised of silver iodobromide. The expression "substantially comprised of silver iodobromide" means that the content of halide(s) other than bromide and iodide (e.g., chloride) is not more than 1 mol % of the entire grains, based on silver. The XPS method or EPMA method applicable in the invention are also well known in the art as an analysis method for silver halide grains or a silver halide emulsion.

To precisely determine the distribution of the surface iodide content in the major face of tabular grains, analysis means having high resolution is needed to apply. The most preferred analysis method usable in the invention is TOF-SIMS (Time of Flight-Scattering Ion Mass Spectroscopy). Exemplarily, according to the method described in JP-A 2000-112049, the average surface iodide content of silver halide grains can be determined by the TOF-SIMS.

In the invention, the average iodide content in the vicinity of the corners of tabular silver halide grains is preferably less than that on the surface. The average iodide content in region near the corners is preferably lower by 0.5 to 8 mol % (and more preferably 1.0 to 6 mol %) than that on the surface. The region near the corner is a region including a corner and divided by a plane vertical to the line connecting the center of the major face and the corner of the tabular grain, at a length of 1/10 of the line from the corner. Thus, when a line is drawn connecting the center of the major face and each of the corners, the region near the corner is a region including the corner and divided by a plane vertical to the line at the position of 1/10 of the line length from the corner. In cases where the corner is rounded, the corner is defined as a point nearest to the intersection of two tangential lines to the adjacent corners.

In the invention, the iodide content in the region near the corner can be determined by analysis by TOF-SIMS.

In the invention, at least one of the phase (A), phase (B) and the outermost phase preferably contains the compound represented by following formula (II):

formula (II)

$$[ML_6]^n$$

wherein M represents a filled frontier orbital polyvalent metal ion; $L_6$ represents six coordinated complex ligands; and n represents -, 2-, 3- or 4-.

The compound represented by formula (II), which is contained in the interior or in the surface portion, is referred to as a dopant. In this regard, introducing the dopant into the interior or the surface of the grain through addition of the dopant during the formation of silver halide grains is also referred to as doping. Silver halide grains may be doped during grain growth or during grain ripening. Alternatively, grain growth is interrupted and after being doped, the growth may further continue. Alternatively, after completion of grain growth, a dopant may be introduced into the grain surface. Doping can also be conducted by carrying out nucleation, physical ripening or grain formation in the presence of a dopant. The dopant concentration is preferably $1\times10^{-8}$ to $1\times10^{-2}$ mol, and more preferably $1\times10^{-6}$ to $1\times10^{-3}$ mol per mol of silver halide.

In formula (II), M is a filled frontier orbital polyvalent metal ion and preferably $Fe^{2+}$, $Os^{2+}$, $Co^{2+}$, $Rh^{2+}$, $Ir^{2+}$, $Pd^{4+}$, or $Pt^{4+}$; $L_6$ represents six coordinated ligands which are independently selected, provided that at least four of the ligands are each an anionic ligand, and at least one of the ligands (preferably at least three, and more preferably at least four of the ligands) is more electronegative than a halide ligand; and n is 1-, 2-, 3- or 4-.

Examples of a dopant or dopant ion capable of providing a shallow electron trap are shown below:

SET-1 $[Fe(CN)_6]^{4-}$
SET-2 $[Ru(CN)_6]^{4-}$
SET-3 $[Os(CN)_6]^{4-}$
SET-4 $[Rh(CN)_6]^{2-}$
SET-5 $[Ir(CN)_6]^{2-}$
SET-6 $[Fe(pyrazine)\ (CN)_5]^{4-}$
SET-7 $[RuCl(CN)_5]^{4-}$
SET-8 $[OsBr(CN)_5]^{4-}$
SET-9 $[RhF(CN)_5]^{2-}$
SET-10 $[IrBr(CN)_5]^{2-}$
SET-11 $[FeCO(CN)_5]^{2-}$
SET-12 $[RuF_2(CN)_4]^{4-}$
SET-13 $[OSCl_2(CN)_4]^{4-}$
SET-14 $[RhI_2(CN)_4]^{2-}$
SET-15 $[IrBr_2(CN)_4]^{2-}$
SET-16 $[Ru(CN)_5(OCN)]^{4-}$
SET-17 $[Ru(CN)_5(N_3)]^{4-}$
SET-18 $[Os(CN)_5(SCN)]^{4-}$
SET-19 $[Rh(CN)_5(SeCN)]^{2-}$
SET-20 $[Ir(CN)_5(HOH)]^{2-}$
SET-21 $[Fe(CN)_3Cl_3]^{2-}$
SET-22 $[Ru(CO)_2(CN)_4]^{1-}$
SET-23 $[Os(CN)Cl_5]^{4-}$
SET-24 $[Co(CN)_6]^{2-}$
SET-25 $[Ir(CN)_4(oxalate)]^{2-}$
SET-26 $[In(NCS)_6]^{2-}$
SET-27 $[Ga(NCS)_6]^{2-}$
SET-28 $[Co(NO_2)_6]^{3-}$
SET-29 $[Ir(NO_2)_6]^{3-}$ Further, as described in U.S. Pat. No. 5,024,931, an enhancement of speed can be achieved by use of an oligomer-coordinated complex. Five- or four-coordinated dopants described in JP-A 11-24194 and 11-109537 may be used; and metal complexes containing a ligand having an adsorption group onto silver halide described in JP-A 11-102042 and 11-184036 are also usable.

To silver halide emulsions relating to the invention iques are applicable the following commonly known techniques: B. H. Carroll, "Iridium Sensitization: A Literature Review", Photogr. Sci. Eng., vol. 24, No. 6, page 265-267 (1980); U.S. Pat. Nos. 1,951,933, 2,628,167, 3,687,676, 3,761,267, 3,890,154, 3,901,711, 3,901,713, 4,173,483, 4,269,927, 4,413,055, 4,477,561, 4,581,327, 4,643,965, 4,806,462, 4,828,962, 4,835,093, 4,902,611, 4,981,780, 4,997,751, 5,057,402, 5,134,060, 5,153,110, 5,164,292, 5,166,044, 5,204,234, 5,166,045, 5,229,263, 5,252,451, 5,252,530; EPO No. 0244184, 0488737, 0488601, 0368304, 0405938, 0509674, 0563046; JP-A 4-125629; WO No. 93/02390. Further, U.S. Pat. Nos. 4,847,191, 4,933,272, 4,981,781, 5,037,732, 4,945,035, 5,112,732: EPO No. 0509674, 0513738; WO No. 91/10166, 92/16876; German Patent No. 298,320; and U.S. Pat. Nos. 5,360,712 and 5,024,931.

The process of preparation of silver halide emulsions comprises, in general, the following steps. Thus, in the first step of the formation of silver halide, i.e., in the nucleation stage, a dispersion containing silver halide nucleus grains are formed. Subsequently, ripening is optionally carried out. Further, continued addition of aqueous silver salt solution and aqueous halide solution transfers to the second step of the silver halide formation, i.e., grain growth stage, in which additional silver halide produced as a reaction product deposits onto the initially formed silver halide nucleus grains to enlarge these grains.

In the preparation method of silver halide emulsion according to the invention, nucleation is preferably carried out at a pBr of 1.8 to 2.8, a pH of 1.5 to 3.0 and a temperature of 5 to 20° C., in the presence of a low molecular weight gelatin having an average molecular weight of not more than 30,000. The lower the nucleation temperature, solubility of silver halide is lowered, increasing the number of produced nucleus grains. At a temperature lower than 5° C., temperature control in the nucleation stage becomes unstable, lowering reproducibility. The gelatin concentration in the nucleation stage is preferably 0.001 to 2%, and more preferably 0.01 to 1% by weight. The methionine content of gelatin is preferably as low as possible, more preferably not more than 50 μmol, and still more preferably not more than 20 μmol per g of gelatin. The methionine content of gelatin can be reduced by subjecting gelatin to an oxidation treatment using an oxidant such as hydrogen peroxide.

In the invention, the silver ion concentration of a reaction solution at the time of completion of nucleation is preferably $1\times10^{-3}$ to $1\times10^{-2}$ mol/l and such a condition can be accomplished by optimal selection of concentrations of a mother liquor and an aqueous silver salt solution to be added at the nucleation. Maintaining the silver ion concentration of the reaction solution at not more than $1\times10^{-2}$ mol/l reduces the proportion of nucleus grains having non-parallel twin planes, thereby enhancing homogeneity of grain size distribution. The silver ion concentration of the reaction solution of less than $1\times10^{-4}$ mol/l results in lowering in productivity in the nucleation stage.

In cases where grain formation is conducted using a tabular seed crystal grain emulsion in the process of preparing silver halide emulsions, the silver ion concentration of an aqueous solution containing the seed grain emulsion within a reaction vessel, before starting silver halide grain growth is preferably $5\times10^{-4}$ to $5\times10^{-2}$ mol/l, and more preferably $1\times10^{-3}$ to $1\times10^{-2}$ mol/l. Such conditions can be achieved by optimal selection of the amount of mother liquor within the reaction vessel in accordance with the amount of the seed grain emulsion. Maintaining the aqueous solution containing the seed grain emulsion within a reaction vessel at a silver ion concentration of not more than $1\times10^{-2}$ mol/l, before starting silver halide grain growth enables preparation of tabular grains having a relatively high aspect ratio and reduced coefficient of variation of grain size. On the contrary, excessively low silver ion concentration of the reaction solution results in lowering in productivity in the stage of silver halide grain growth.

In the preparation method of silver halide emulsions of invention, at least a part of the ripening step is preferably conducted in the presence of a silver halide solvent or at a pH of 7 to 12. Further, the ripening temperature is preferably 40 to 80° C., and more preferably 50 to 70° C. Examples of the silver halide solvent include ammonia, thicyanates (e.g., potassium rhodanide, ammonium rhodanide), organic thioethers (as described in U.S. Pat. Nos. 3,574,628, 3,021,215, 3,057,724, 3,038,805, 4,276,374, 4,297,439, 3,704,130, 4,782,013; and JP-A 57-104926), thione compounds (e.g., tetra-substituted thioureas described in JP-A 53-82408 and 55-77737; U.S. Pat. No. 4,782,013, compounds described in JP-A 53-144319), mercapto compounds capable of promoting silver halide rain growth, as described in JP-A 57-202531; and amine compounds (e.g., as described in JP-A 54-100717).

In the silver halide emulsions or preparation method thereof, relating to the invention, a concentration operation by means of ultrafiltration is preferably conducted at the time nucleation is completed. Specifically, in the preparation process including the nucleation step in which the silver ion concentration of the reaction solution is not more than $1\times10^{-2}$ at the completion of nucleation, the use of ultrafiltration in the subsequent process after completion of nucleation markedly improves productivity in the concentration stage of silver halide emulsions. When conducting concentration of silver halide emulsion by ultrafiltration in the process of preparation of silver halide emulsion relating to the invention, a manufacturing installation of silver halide emulsions described in JP-A 10-339923 is preferably employed.

Silver halide emulsions relating to the invention are preferably subjected to reduction sensitization. Reduction sensitization nuclei may be formed on the silver halide grain surface or formed during grain growth. To provide the reduction nuclei to silver halide grains are known a method of adding a reducing agent (hereinafter, also referred to as a reduction sensitizer) to a silver halide emulsion or to a solution to be used for grain growth, and a method of ripening a silver halide emulsion under the environment of a low pAg of not more than 7 or a high pH of not less than 7, or undergoing grain formation under the same environment. Of these, addition of a reducing agent, which can be achieved without exerting any influence on growth of silver halide grains, is preferred to optimally undergo reduction sensitization. Preferred examples of reduction sensitizers include stannous salts, amines and polyamines, hydrazine derivatives, formamidine-sulfinic acid, silane compounds, and borane compounds. These reduction sensitizers may be used alone or in combination. The amount of a reduction sensitizer to be added, depending on emulsion-making conditions, is preferably $1\times10^{-7}$ to $1\times10^{-2}$ mol, $1\times10^{-6}$ to $1\times10^{-3}$ mol per mol of silver halide. Reduction sensitizers are dissolved in solvents such as water, alcohols, glycols, ketones, esters, or amides and added during grain growth. The reduction sensitizer may be added to the reaction vessel in advance but is preferably added at a time during grain growth. A reduction sensitizer is added, in advance, to an aqueous silver salt solution or halide solution, and precipitation of silver halide grains may be performed using this solution. Further, the reduction sensitizer solution is divided into a few parts and may intermittently be added. Alternatively, it may continuously be added over a long period of time.

There is preferably employed a method, in which when intended formation of reduction sensitization nuclei is completed during formation of silver halide grains, a compound capable of oxidizing silver is added to oxidize post-formed reduction sensitization nuclei (silver nuclei). As an oxidizing agent used for the purpose thereof is effective a compound a function of converting metallic silver to a silver ion. Such an oxidizing agent not only oxidizes unwanted reduction sensitization nuclei but also converts fine silver nuclei produced during grain formation or chemical sensitization to silver ions to effectively reduce fogging. The silver ion formed by the action of the oxidizing agent may further be converted to a scarcely water-soluble silver salt such as silver halide, silver sulfide or silver selenide, or to a water soluble salt such as silver nitrate. Oxidizing agents usable in the invention include inorganic and organic compounds. Examples of inorganic oxidants include ozone; oxygen acids and salts thereof, such as hydrogen peroxide and its adducts (e.g., $NaBO_2\cdot H_2O\cdot 3H_2O$, $aNa_2CO_3\cdot 3H_2O_2\cdot Na_4P_2O_7\cdot 2H_2O_2$, $2Na_2SO_4\cdot H_2O_2\cdot 2H_2O$), peroxyacid salts (e.g., $K_2S_2O_8$, $K_2C_2O_6$, $K_2P_2O_8$), peroxy complex compound {e.g., $k_2[Ti(O_2)C_2O_4]\cdot 3H_2O$, $4K_2SO_4\cdot Ti(O_2)OH\cdot SO_4\cdot 2H_2O$, $Na_3[VO(O_2)(C_2H_4)_26H_2O]$}, permaganates (e.g., $KMnO_4$), and chromates (e.g., $K_2Cr_2O_7$); high valent metal salts (e.g., potassium ferrihexacyanate) and thiosulfonates. Examples of organic oxidants include quinines such as p-quinone; organic peroxide compounds such as peracetic acid or perbenzoic acid; and active halogenreleasing compounds (e.g., N-bromsuccimide, chloramine T, chloramines B). Of these, inorganic oxidants of ozone, hydrogen peroxide and its adducts, halogen elements, thiosufinates and inorganic oxidants of quinines are preferred as oxidants for silver halide emulsions relating to the invention. These oxidants lowers fogging levels and may added during grain formation or during chemical sensitization and are preferably added before chemical sensitization.

To silver halide emulsions relating to the invention may be applied an epitaxial emulsion technique described in U.S. Pat. No. 4,435,501 and 4,471,050; JP-A 8-69069, 9-211762 and 9-211763. A method described in U.S. Pat. No. 4,435,501, for example, can be employed, in which a sensitizing dye is adsorbed onto the tabular grain surface to form an aggregation in such a state that silver halide epitaxy is directed to the edge or corner of the tabular grain. Cyanine dyes capable of adsorbing onto the surface of host tabular rains in a J-aggregate form are a preferrd cite-director. It is also taught that using a non-dye-absorbing cite-director such as aminoazaindenes (e.g., adenine), epitaxy is allowed to be directed to the edge or corner of the tabular grain. However, preparation of the epitaxial emulsion is not specifically limited to these but other technique may be applicable. In cases when applying this epitaxial technique to silver halide emulsions relating to the invention, it is preferred to limit the silver halide epitaxy to less than 50 mol %, based on total silver. The extent of the silver halide epitaxy is more preferably 0.3 to 25 mol %, and optimally 0.5 to 15 mol % for sensitization. Epitaxy to a specifically limited portion on the silver halide grain surface is more efficient than epitaxy covering the overall surface. In the case of a host grains being a tabular silver halide grain, for example is preferred epitaxy substantially limited to the corner of the host tabular grain, and of which coverage on the major faces is also limited. Further, epitaxy limited to the corner or its vicinity, or limited to separated cites is more efficient.

In the process of preparing silver halide emulsions relating to the invention, in addition to the foregoing conditions, optimal conditions can be selected referring to JP-A61-6643, 61-14630, 61-112142, 62-157024, 62-18556, 63-92942, 63-151618, 63-163451, 63-220238 and 63-311244; Research Disclosure (hereinafter, also denoted as "RD") No. 38987, Sect. I and III, and RD 40145, Sect. XV.

In cases when constituting a color photographic material using silver halide emulsions according to the invention are employed silver halide emulsions according to the invention, which have been subjected to physical ripening, chemical sensitization and spectral sensitization. Additives used in such a process are described in RD38957, Sect. IV and V, RD40145, Sect. XV. Commonly known photographic additives usable in the invention are also describe din RD 38957, Sect. II to X and RD 40145, Sect. I to XIII.

Silver halide photographic materials relating to the invention may be provided with red-, green- and blue-sensitive silver halide emulsion layers, each of which may each preferably exhibit an absorption maximum farther by at least 20 nm the other dyes. The use of a cyan coupler, magenta coupler and yellow coupler is preferred as a coupler. The combination with a coupler and an emulsion layer is preferably the combination of a yellow coupler and a blue-sensitive layer, that of a magenta coupler and a green-sensitive layer, and that of a cyan coupler and a red-sensitive layer, but is not limited to these combinations and other combinations may be acceptable.

DIR compounds may be used in the invention. Examples of DIR compounds usable in the invention include those described in JP-A 4-114153, D-1 through D-34. These compounds are preferably used in the invention. Further, examples of usable DIR compounds include those described in U.S. Pat. Nos. 4,234,678, 3,227,554, 3,647,291, 3,958,993, 4,419,886, 3,933,500; JP-A 57-56837, 51-13239; U.S. Pat. 2,072,363, 2,070266; and RD 40145, Sect. XIV.

Exemplary examples of couplers usable in the invention are those described in RD 40145, Sect. II. Additives used in the invention can be incorporated using a dispersing method described in RD 40145, Sect. VIII. Commonly known supports, as described in RD 38957, Sect. XV are also usable in the invention. Auxiliary layers such as a filter layer or interlayer, as describe din RD 38957, Sect. XI may be provided in photographic materials relating to the invention. Photographic materials can have various layer arrangements such as convention layer order, reverse order and unit constitution, as described in RD 38957, Sect. XI.

Silver halide emulsions according to the invention can be applied to various color photographic materials, such as color negative films used for general purpose or cine films, color reversal films for reversal or television, color paper, color positive films, color reversal paper.

Photographic materials relating to the invention can be processed using commonly known developers describe in T. H. James, The Theory of The Photographic Process, Forth Edition, pages 291 to 334; J. Am. Chem. Soc. 73, 3100 (1951), in accordance with the conventional process, as describe din RD 38957, Sect. XVII to XX, and RD 40145, Sect. XXIII.

EXAMPLES

Embodiments of the present invention will be explained based on examples, but the invention is by no means limited to these examples.

Example 1

Preparation of Tabular Seed Grain Emulsion

Tabular seed grain emulsion 1 was prepared in accordance with the following procedure.

Nucleation

A 28.3 lit. aqueous solution containing 162.8 g of low molecular weight gelatin (Av. molecular weight of 15,000) and 23.6 g of potassium bromide was maintained at 15° C. within a reaction vessel with stirring by a stirring mixer apparatus described in JP-A 62-160128 and adjusted to a pH of 1.90 using 0.5 M sulfuric acid. Ten, the following solutions, S-01 and X-01 were added by the double jet addition at a constant flow rate over a period of 1 min. to form nucleus grains (i.e., nucleation) and then, the following solution, G-01 was added.

Solution S-01: 205.7 ml of 1.25 mol/l silver nitrate solution

Solution X-01: 205.7 ml of 1.25 mol/l potassium bromide solution

Solution G-01: 2921 ml of aqueous solution containing 120.5 g of alkali-processed, inert gelatin (av. molecular weight of 100,000) and 8.8 ml of a 10 wt % methanol solution of surfactant A Surfactant A: $HO(CH_2CH_2O)_m[CH(CH_3)CH_2O]_{20}(CH_2CH_2O)_nH$ (m+n=10)

Ripening

After completion of nucleation, the temperature was raised to 60° C. in 45 min. and the pAg was adjusted to 9.2. Subsequently, the pH was adjusted to 9.3 with an aqueous solution containing 0.138 mol ammonia and aqueous potassium hydroxide solution, and after being maintained for 6 min., the pH was adjusted to 6.1 with 1 mol/l nitric acid.

Growth

After completion of ripening, the following solutions S-02 and X-02 were added by the double jet addition at an accelerated flow rate (about 5 times faster at the end that at the start) over a period of 20 min.

Solution S-02: 2620 ml of 1.25 mol/l silver nitrate solution

Solution X-01: 2620 ml of 1.25 mol/l potassium bromide solution

After completion of addition of the solutions, the emulsion was desalted with conventional washing method, and additional gelatin was added and dispersed. The thus obtained emulsion was comprised of tabular grains having a average equivalent cubic diameter of 0.25 μm, an average equivalent circular diameter of 0.67 μm, an average thickness of 0.056 μm, an average aspect ratio of 12.0 and a coefficient of variation of grain size of 14.2%. The emulsion was denoted as tabular seed emulsion 1.

Preparation of Tabular Silver Halide Emulsion 1-A

Subsequently, using tabular seed emulsion 1, grain growth was performed according to the following procedure to obtain tabular grain emulsion 1-A.

Formation of phase (A)

To 15 lit. of aqueous 1% gelatin solution containing 0.21 mole equivalent tabular seed emulsion 1 and 1.0 ml of a 10% methanol solution of the foregoing surfactant A, the following solutions S-11 and X-11 were added by the double jet addition at an accelerated flow rate (about 10 times faster at the end than at the start) to form phase (A), while the temperature and pAg were maintained at 60° C. and 9.2, respectively. After forming the phase (A), the average aspect ratio was 24.1.

Solution S-11: 2059 ml of 3.5 mol/l silver nitrate solution

Solution X-01: 2059 ml of 3.45 mol/l potassium bromide and 0.05 mol/l potassium iodide solution Formation of Phase (B)

After completion of forming phase (A), the following solution I-11 and Z-11 were added and the mixture was adjusted to a pH of 9.3 with an aqueous potassium hydroxide solution and maintained for 6 min. and then adjusted to a pH of 5.0 with aqueous acetic acid solution and to a pAg of 9.7 with aqueous potassium bromide solution. Subsequently, the following solutions S-12 and X-12 were added by the doble jet addition at an accelerated flow rate (about 2.2 times faster at the end than at the start) to form phase (B).

Solution I-11: aqueous solution containing 57.7 g of sodium p-iodoacetoamidobenzene sulfonate Solution Z-11: aqueous solution containing 20.0 g of sodium sulfite Solution S-12: 726 ml of 3.5 mol/l silver nitrate solution Solution X-12: 726 ml of 3.25 mol/l potassium bromide and 0.25 mol/l potassium iodide solution Formation of Outermost Phase Subsequent to the formation of phase (B), the following solutions S-13 and X-13 were added at an accelerated flow rate ( about 1.4 times faster at the end than at the start) to form the outermost phase.

Solution S-13: 509 ml of 1.25 mol/l silver nitrate solution

Solution X-13: 509 ml of 1.25 mol/l potassium bromide solution

After completion of forming the outermost phase, the emulsion was desalted according to the method described in JP-A 5-72658, additional gelatin was added and dispersed, the pH and pAg were adjusted to 5.8 and 8.1 at 40° C., respectively to obtain silver halide tabular grain emulsion 1-A. The thus obtained emulsion 1-A was comprised of tabular grains having an aspect ratio of 2 or more, an average equivalent cubic edge length of 1.0 μm, an average aspect ratio of 18.3 and a coefficient of variation of grain size of 14%, in which 88% of the total grain projected area was accounted for by tabular grains having an aspect ratio of 15 or more and the average iodide content on the grain surface was 9.2 mol %. Herein, the equivalent cubic edge length is referred to as an edge length of a cube having the volume equivalent to the volume of the tabular grain. It was further proved that in silver halide tabular grain emulsion 1-A, 82% of the total grain projected area was accounted for by tabular grains having at least 5 dislocation lines, and 82% by number of the tabular grains having an adjacent edge ratio of 0.5 to 2.0. From electron microscopic observation of the tabular grains, it was also proved that a mean spacing between twin planes was 0.008 μm and the ratio of grain thickness to phase (B) thickness was 3.4.

Preparation of Tabular Silver Halide Emulsion 1-B through 1-K

Tabular silver halide emulsions 1-B through 1-K having grain structure or characteristics, as shown in Table 1 were each prepared similarly to tabular silver halide emulsion 1-A, provided that solutions S-11 to S-13 and X-11 to X-13 were varied with respect to amount and composition to be added, and the pBr and flow rate were optimally varied. From sectional observation of tabular silver halide emulsions 1-F and 1-H, the ratio of grain thickness to phase (B) thickness was 4.5 and 5.8, respectively.

TABLE 1

| Emulsion | A-Phase*1 | | B-Phase | | C-Phase | | Av. Iodide Content | AR ≧ 12 | |
|---|---|---|---|---|---|---|---|---|---|
| No. | A (mol %) | Ag (%)*2 | B (mol %) | Ag (%) | C (mol %) | Ag (%) | (mol %) | (%) | Remark |
| 1-A | 1.5 | 70.0 | 13.3 | 24.0 | 0.0 | 6.0 | 4.2 | 94 | Inv. |
| 1-B | 3.0 | 70.0 | 13.3 | 24.0 | 4.0 | 6.0 | 5.5 | 87 | Inv. |
| 1-C | 4.0 | 70.0 | 13.3 | 24.0 | 5.0 | 6.0 | 6.3 | 68 | Comp. |
| 1-D | 1.5 | 70.0 | 28.0 | 24.0 | 0.0 | 6.0 | 7.8 | 72 | Comp. |
| 1-E | 1.5 | 70.0 | 6.3 | 24.0 | 0.0 | 6.0 | 2.6 | 96 | Comp. |
| 1-F | 1.5 | 80.0 | 22.0 | 10.0 | 0.0 | 10.0 | 3.4 | 95 | Inv. |
| 1-G | 1.5 | 42.0 | 13.3 | 38.0 | 0.0 | 18.0 | 5.7 | 60 | Comp. |
| 1-H | 1.5 | 92.0 | 24.0 | 8.0 | 0.0 | 0.0 | 3.3 | 98 | Comp. |
| 1-I | 1.5 | 75.0 | 16.5 | 10.0 | 0.0 | 15.0 | 2.8 | 95 | Comp. |
| 1-J | 3.0 | 50.0 | 25.0 | 35.0 | 4.0 | 15.0 | 10.9 | 67 | Inv. |
| 1-K | 8.0 | 50.0 | 30.0 | 35.0 | 4.0 | 15.0 | 15.7 | 35 | Comp. |

*1A-phase including a seed grain

*2Percentage, based on silver

Further, designations in Table 1 are as follows:

A (mol %): Average iodide content of phase (A)

B (mol %): Average iodide content of phase (B)

C (mol %): Average iodide content of outermost phase

Av. Iodide content: Average iodide content of tabular grain emulsion

AR≧12 (%): percentage of tabular grains having an aspect ratio of 12 or more, based on grain projected area.

Preparation of Silver Halide Color Photographic Material

The following layers having composition as shown below were formed on a 120 μm, subbed triacetyl cellulose film support to prepare a multi-layered color photographic material Sample. The addition amount of each compound was represented in term of g/M$^2$, unless otherwise noted. The amount of silver halide or colloidal silver was converted to the silver amount and the amount of a sensitizing dye (denoted as "SD") was represented in mol/Ag mol.

1st Layer: Anti-Halation Layer

| | |
|---|---|
| Black colloidal silver | 0.16 |
| UV-1 | 0.30 |
| CM-1 | 0.12 |
| CC-1 | 0.03 |
| OIL-1 | 0.24 |
| Gelatin | 1.33 |

2nd Layer: Interlayer

| | |
|---|---|
| Silver iodobromide emulsion j | 0.10 |
| AS-1 | 0.12 |
| OIL-1 | 0.15 |
| Gelatin | 0.67 |

3rd Layer: Low-Speed Red-Sensitive Layer

| | |
|---|---|
| Silver iodobromide emulsion c | 0.053 |
| Silver iodobromide emulsion d | 0.11 |
| Silver iodobromide emulsion e | 0.11 |
| SD-1 | $2.2 \times 10^{-5}$ |
| SD-2 | $5.9 \times 10^{-5}$ |
| SD-3 | $1.2 \times 10^{-4}$ |
| SD-4 | $1.6 \times 10^{-4}$ |
| SD-5 | $1.6 \times 10^{-4}$ |
| C-1 | 0.19 |
| CC-1 | 0.003 |
| OIL-2 | 0.096 |
| AS-2 | 0.001 |
| Gelatin | 0.44 |

4th Layer: Medium-Speed Red-Sensitive Layer

| | |
|---|---|
| Silver iodobromide emulsion b | 0.28 |
| Silver iodobromide emulsion c | 0.34 |
| Silver iodobromide emulsion d | 0.50 |
| SD-1 | $1.8 \times 10^{-5}$ |
| SD-4 | $2.6 \times 10^{-4}$ |
| SD-5 | $2.8 \times 10^{-4}$ |
| C-1 | 0.74 |
| CC-1 | 0.081 |
| DI-1 | 0.020 |
| DI-4 | 0.008 |
| OIL-2 | 0.42 |

-continued

| | |
|---|---|
| AS-2 | 0.003 |
| Gelatin | 1.95 |

5th Layer: High-Speed Red-Sensitive Layer

| | |
|---|---|
| Silver iodobromide emulsion a | 1.45 |
| Silver iodobromide emulsion e | 0.076 |
| SD-1 | $2.3 \times 10^{-5}$ |
| SD-2 | $1.1 \times 10^{-4}$ |
| SD-3 | $1.5 \times 10^{-5}$ |
| SD-4 | $2.1 \times 10^{-4}$ |
| C-2 | 0.087 |
| C-3 | 0.12 |
| CC-1 | 0.036 |
| DI-1 | 0.021 |
| DI-3 | 0.005 |
| BAR-1 | 0.002 |
| OIL-2 | 0.15 |
| AS-2 | 0.004 |
| Gelatin | 1.40 |

6th Layer: Interlayer

| | |
|---|---|
| F-1 | 0.03 |
| AS-1 | 0.18 |
| OIL-1 | 0.22 |
| Gelatin | 1.00 |

7th Layer: Low-Speed Green-Sensitive Layer

| | |
|---|---|
| Silver iodobromide emulsion c | 0.22 |
| Silver iodobromide emulsion e | 0.22 |
| SD-6 | $4.7 \times 10^{-5}$ |
| SD-7 | $2.6 \times 10^{-4}$ |
| SD-8 | $1.9 \times 10^{-4}$ |
| SD-9 | $1.1 \times 10^{-4}$ |
| SD-10 | $2.4 \times 10^{-5}$ |
| M-1 | 0.35 |
| CM-1 | 0.044 |
| DI-2 | 0.010 |
| OIL-1 | 0.41 |
| AS-2 | 0.001 |
| AS-3 | 0.11 |
| Gelatin | 1.29 |

8th Layer: Medium-Speed Green-Sensitive Layer

| | |
|---|---|
| Silver iodobromide emulsion b | 0.90 |
| Silver iodobromide emulsion e | 0.048 |
| SD-6 | $3.8 \times 10^{-5}$ |
| SD-7 | $2.6 \times 10^{-5}$ |
| SD-8 | $3.4 \times 10^{-4}$ |
| SD-9 | $1.6 \times 10^{-4}$ |
| SD-10 | $4.4 \times 10^{-5}$ |
| M-1 | 0.15 |
| CM-1 | 0.062 |
| CM-2 | 0.030 |
| DI-2 | 0.032 |
| OIL-1 | 0.28 |
| AS-2 | 0.005 |
| AS-3 | 0.045 |
| Gelatin | 1.00 |

9th Layer: High-Speed Green-Sensitive Layer

| | |
|---|---|
| Emulsion M | 1.39 |
| Silver iodobromide emulsion e | 0.073 |
| SD-6 | $4.1 \times 10^{-5}$ |
| SD-7 | $2.6 \times 10^{-5}$ |
| SD-8 | $3.7 \times 10^{-4}$ |
| SD-10 | $4.9 \times 10^{-5}$ |
| M-1 | 0.071 |
| M-2 | 0.073 |
| CM-2 | 0.013 |
| DI-2 | 0.004 |
| DI-3 | 0.003 |
| OIL-1 | 0.27 |
| AS-2 | 0.008 |
| AS-3 | 0.043 |
| Gelatin | 1.35 |

10th Layer: Yellow Filter Layer

| | |
|---|---|
| Yellow colloidal silver | 0.008 |
| AS-1 | 0.15 |
| OIL-1 | 0.18 |
| X-1 | 0.06 |
| Gelatin | 0.83 |

11th Layer: Low-speed Blue-Sensitive Layer

| | |
|---|---|
| Silver iodobromide emulsion g | 0.22 |
| Silver iodobromide emulsion h | 0.099 |
| Silver iodobromide emulsion i | 0.17 |
| SD-11 | $2.4 \times 10^{-4}$ |
| SD-12 | $5.7 \times 10^{-4}$ |
| SD-13 | $1.3 \times 10^{-4}$ |
| Y-1 | 1.02 |
| BAR-1 | 0.022 |
| OIL-1 | 0.42 |
| AS-2 | 0.003 |
| X-1 | 0.11 |
| X-2 | 0.18 |
| Gelatin | 1.95 |

12th Layer: High-Sped Blue-sensitive Layer

| | |
|---|---|
| Silver iodobromide emulsion f | 1.52 |
| SD-11 | $8.3 \times 10^{-5}$ |
| SD-12 | $2.3 \times 10^{-4}$ |
| Y-1 | 0.22 |
| DI-5 | 0.11 |
| OIL-1 | 0.13 |
| AS-2 | 0.003 |
| X-1 | 0.15 |
| X-2 | 0.20 |
| Gelatin | 1.20 |

13th Layer: First Protective Layer

| | |
|---|---|
| Silver iodobromide emulsion j | 0.30 |
| UV-1 | 0.11 |
| UV-2 | 0.055 |
| Liquid paraffin | 0.28 |
| X-1 | 0.079 |
| Gelatin | 1.00 |

14th Layer: Second Protective Layer

| | |
|---|---|
| PM-1 | 0.13 |
| PM-2 | 0.018 |
| WAX-1 | 0.021 |
| Gelatin | 0.55 |

Photographic material samples 1-A through 1-K were prepared, provided that tabular silver halide emulsions 1-A through 1-K were used as Emulsion M of the 9th layer.

Characteristics of silver iodobromide emulsions a through j described above are shown below, in which the grain size refers to an edge length of a cube having the same volume as that of the grain.

| Emulsion | Av. grain size ($\mu$m) | Av. Iodide content (mol %) | Diameter/thickness ratio |
|---|---|---|---|
| a | 0.85 | 4.2 | 7.0 |
| b | 0.70 | 4.2 | 6.0 |
| c | 0.50 | 4.2 | 5.0 |
| d | 0.38 | 8.0 | Octahedral, twinned |
| e | 0.27 | 2.0 | Tetradehedral, twinned |
| f | 1.00 | 8.0 | 4.5 |
| g | 0.74 | 3.5 | 6.2 |
| h | 0.44 | 4.2 | 6.1 |
| i | 0.30 | 1.9 | 5.5 |
| j | 0.03 | 2.0 | 1.0 |

With regard to the foregoing emulsions a through i and M, except for emulsion j, after adding the foregoing sensitizing dyes to each of the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molicular weights of 10,000 and 1.100,000; inhibitors AF-3, AF-4 and AF-5; hardener H-1 and H-2; and antiseptic Ase-1. As liquid paraffin was used Merck Index 117139 (available from Merck Co.).

The structure of the compounds used in the sample are shown below.

Y-1
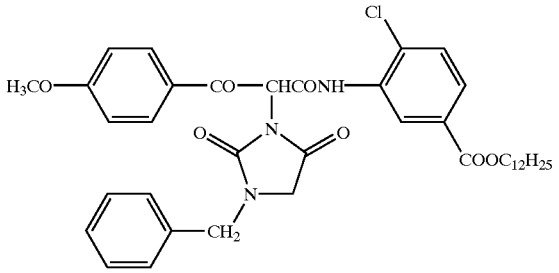
M-1
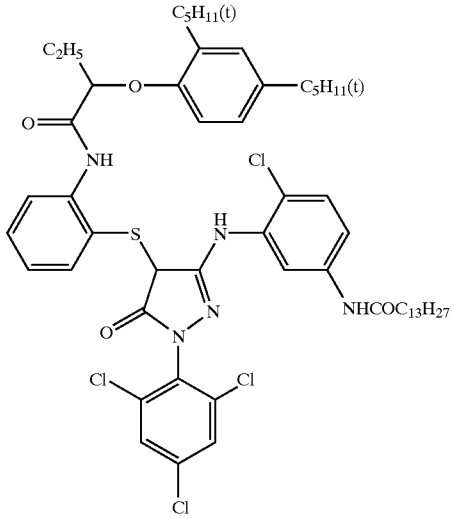
M-2
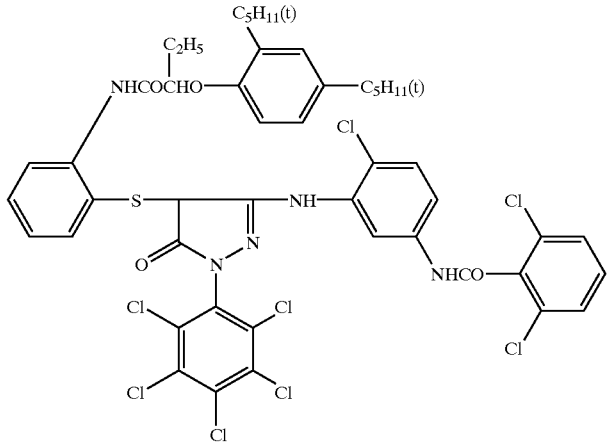
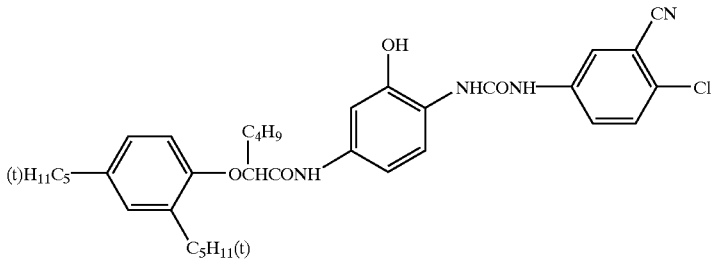
C-2
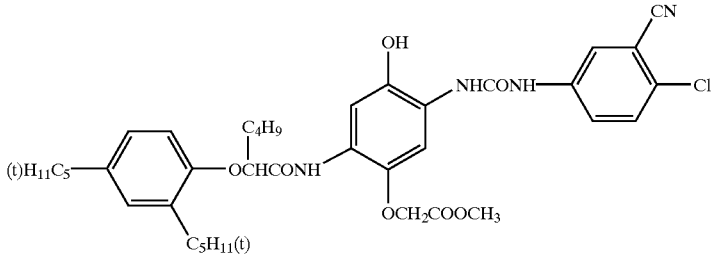

-continued
C-3
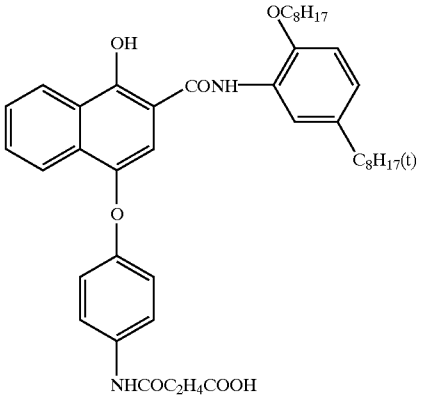
BAR-1
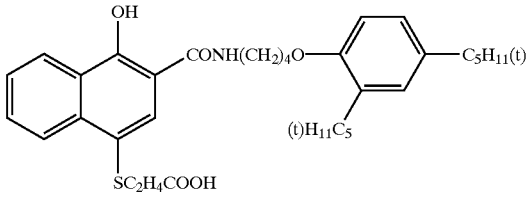
CC-1
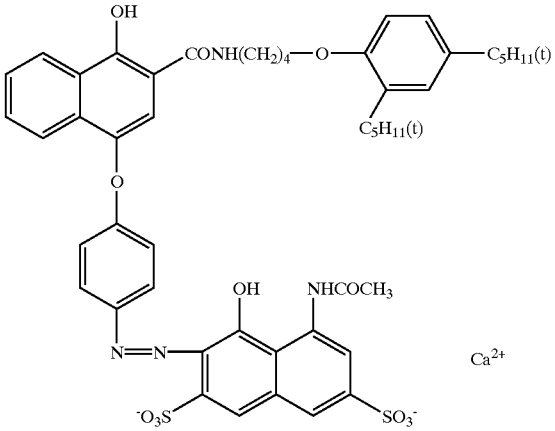
CM-1
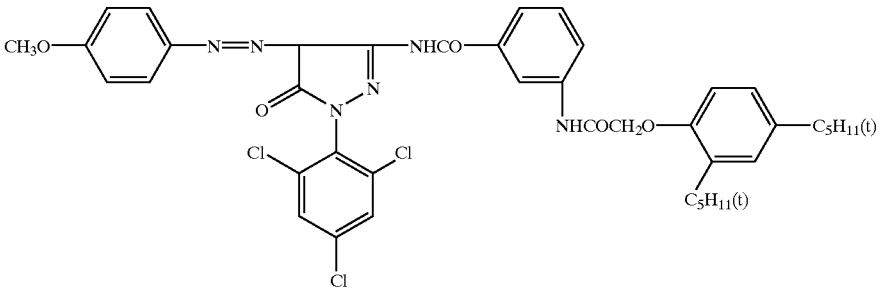
CM-2
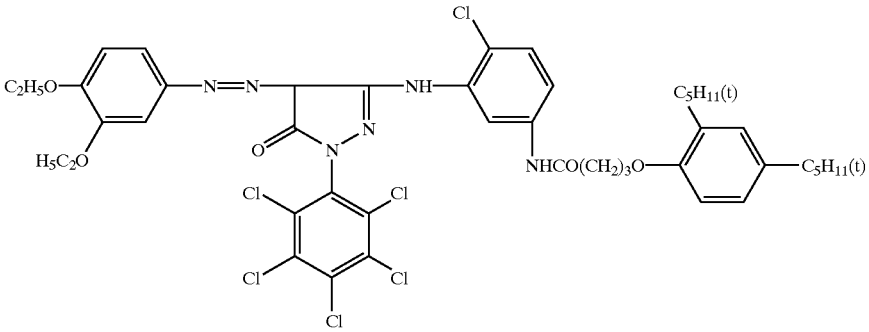

-continued
DI-1
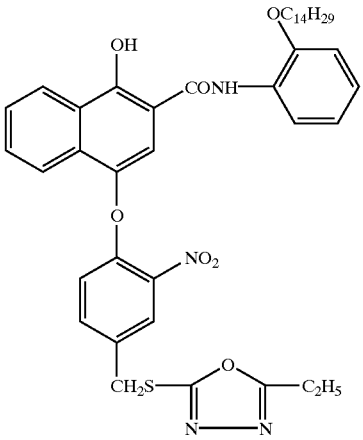
DI-2
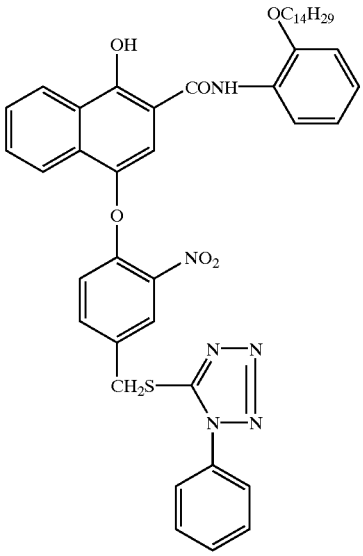
DI-3
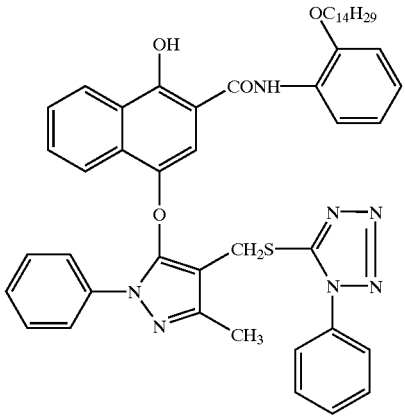
DI-4
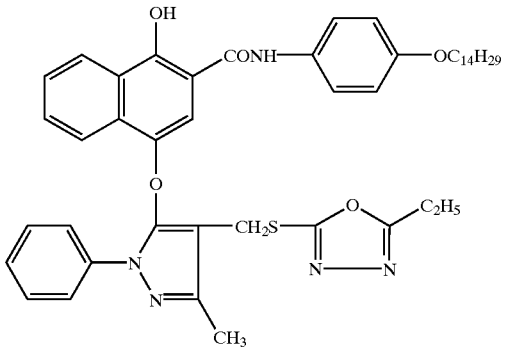
DI-5
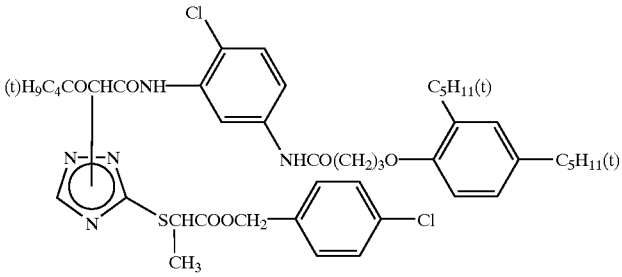
AS-1
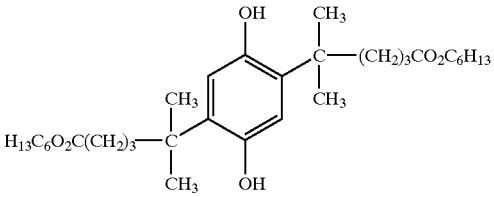
AS-2
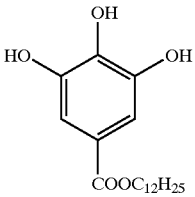
AS-3
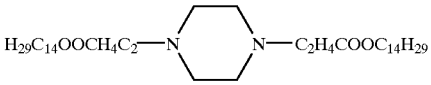
OIL-1
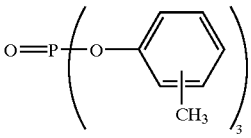

-continued
UV-1
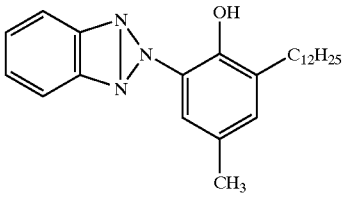
UV-2
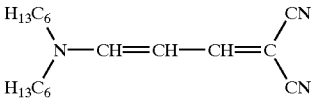
OIL-2
$H_9C_4OOC(CH_2)_8COOC_4H_9$
V-1
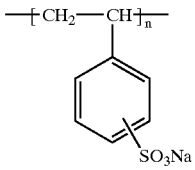
n: Polymerization degree
Ase-1 (mixture)
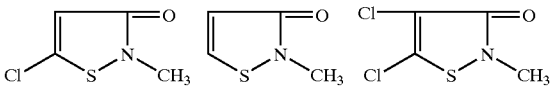
A B C
A:B:C = 50:46:4 (molar ratio)
H-1
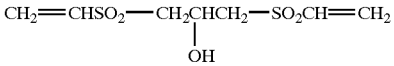
H-2
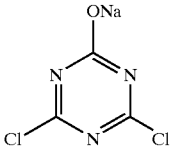
SD-1
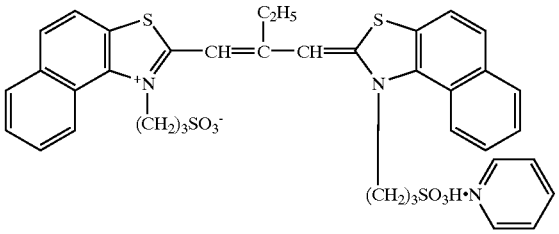
SD-2
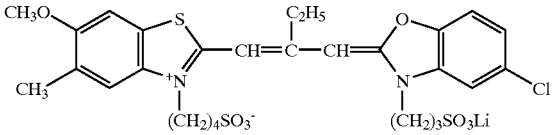
SD-3
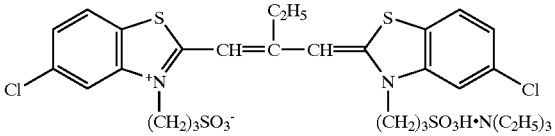
SD-4
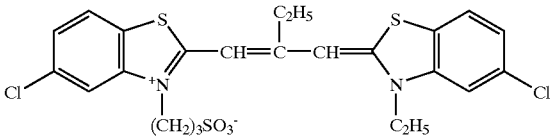
SD-5
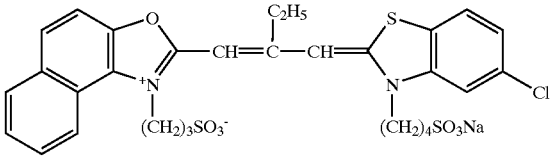

-continued
SD-6
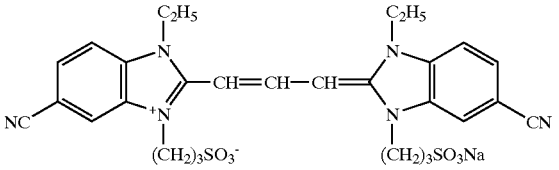
SD-7
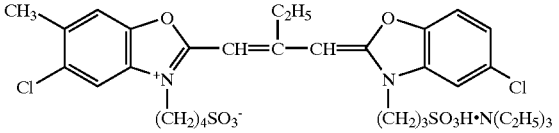
SD-8
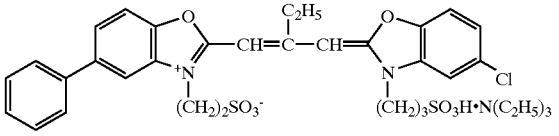
SD-9
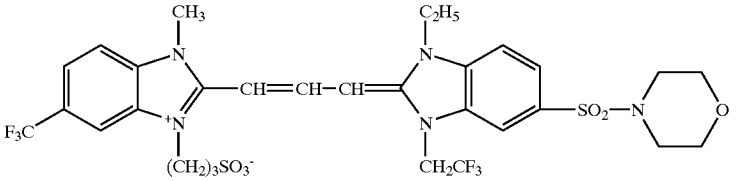
SD-10
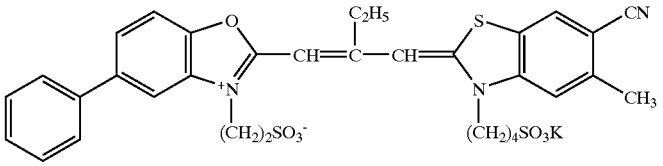
SD-11
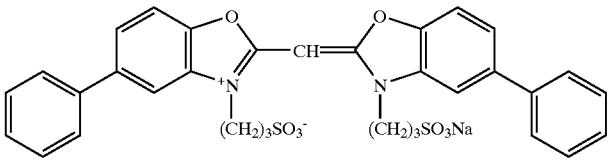
SD-12
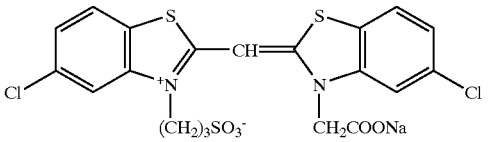
SD-13
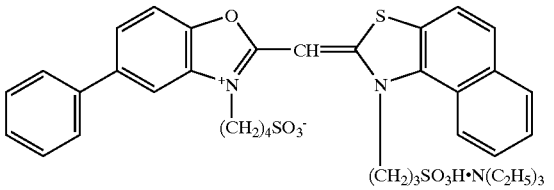
F-1
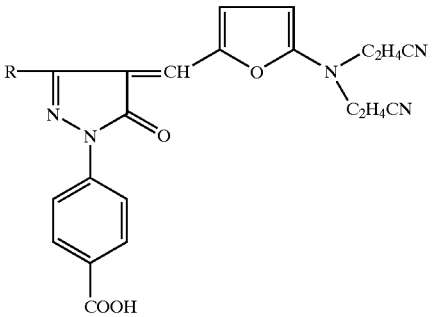
R:—— $CH_3$:CN (6:4)
Molar ratio mixture
ST-1
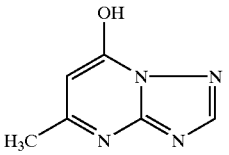

-continued

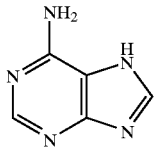

ST-2

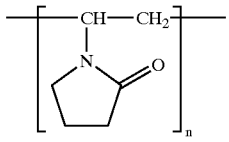

AF-1 Mw≈10,000
AF-2 Mw≈100,000
n: Polymerization degree

AF-1,2

AF-3

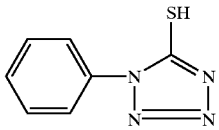

AF-4

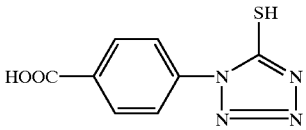

AF-5

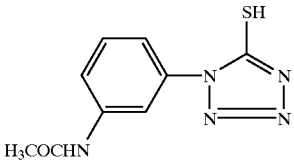

X-1

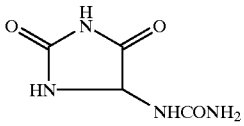

X-2

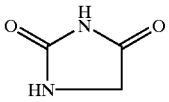

SU-1

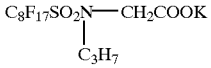

$C_8F_{17}SO_2NH(CH_2)_3\overset{+}{N}(CH_3)_3Br^-$

SU-3

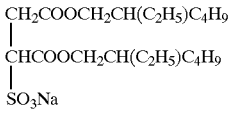

SU-4

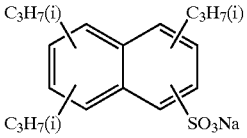

WAX-1

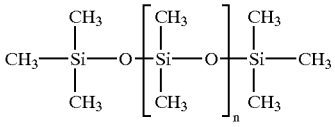

Mw = 3,000

PM-1

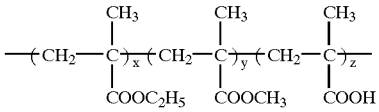

x:y:z = 3:3:4

PM-2

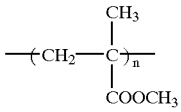

n: Polymerization degree

Exposure, Processing and Evaluation of Photographic Performance

For each of the thus prepared samples were prepared two parts, one of which was exposed to radiation of 200 mR dose using 137 Cs as a radiation source. The other part was not exposed to any radiation. Thereafter, exposure and processing were carried out for each sample. Thus, samples were each exposed to light through an optical stepped wedge for a period of 1/200 sec., using a 5400° K. light source and then processed in accordance with the process described in JP-A 10-123652, col. [0220] through [0227]. Subsequently, processed samples were measured with respect to magenta density, using a densitometer produced by X-rite Co. A characteristic curve of density (D) and exposure (Log E) was prepared to evaluate the fog density, sensitivity and graininess. The fog density was determined as a magenta density of unexposed areas of each of processed samples (also denoted as minimum density) and represented by a relative value, based of the fog density of Sample 1-E being 100. Sensitivity was represented by a relative value of the reciprocal of exposure necessary to give a magenta density of the minimum density plus 0.10, based on the sensitivity of Sample 1-E being 100. Graininess was also represented by a relative value of an RMS value determined with green light at the position of a magenta density of the minimum density plus 0.10, based on the RMS value of Sample 1-E being 100. Object portions to be measured were scanned using a microdensitometer (having a slit width of 10 $\mu$m and a slit length of 180 $\mu$m) provided with Wratten filter (W-99, available from Eastman Kodak Co.) and the RMS value was determined as a standard deviation of densities of a densitometry sampling number of 1,000 or more. An increase of fog density caused by exposure to radiation was evaluated by a relative value of the difference in fog density between being exposed and not being exposed to radiation (denoted as Δfog), based on the Δfog of Sample 1-E being 100.

Evaluation results are shown in Table 7.

TABLE 7

| Sample | Sample Unexposed to Radiation | | | | |
|---|---|---|---|---|---|
| No. | Fog | Sensitivity | RMS | Δ Fog | Remark |
| 1-A | 88 | 115 | 82 | 86 | Inv. |
| 1-B | 76 | 109 | 79 | 73 | Inv. |
| 1-C | 75 | 87 | 77 | 84 | Comp. |
| 1-D | 96 | 94 | 84 | 93 | Comp. |
| 1-E | 100 | 100 | 100 | 100 | Comp. |
| 1-F | 91 | 118 | 88 | 86 | Inv. |
| 1-G | 113 | 84 | 96 | 135 | Comp. |
| 1-H | 70 | 75 | 69 | 108 | Comp. |
| 1-I | 124 | 106 | 108 | 144 | Comp. |
| 1-J | 79 | 104 | 74 | 81 | Inv. |
| 1-K | 67 | 82 | 71 | 103 | Comp. |

As can be seen from comparison of Samples 1-A, 1-B and 1-I through 1-K, it was shown that the use of silver halide emulsions having an average iodide content of 3 to 15 mol %, and phase (A), phase (B) and the outermost phase meeting the requirement of the invention, in which at least 50% of the tabular rain projected area is accounted for by tabular grains having an aspect ration of 15 or more, led to superior results.

From comparison of Samples 1-A through 1-E, it was proved that the iodide content of the grain structure as defined in the invention (including phase (A), phase (B) and outermost phase) was an important factor. Similarly, from comparison of Samples 1-A to 1-E, it was proved that the silver ratio of the grain structure as defined in the invention was also an important factor.

From grain analysis and evaluation results of Sample 1-A, 1-F and 1-H, it was proved that superior results were achieved by the use of an emulsion having less than 5 of the ratio of grain thickness to phase (B) thickness in the section vertical to the major faces.

Example 2

Preparation of Tabular Silver Halide Emulsion 1-L

Silver halide tabular grain emulsion 1-L was prepared similarly to silver halide tabular grain emulsion 1-A of Example 1, except that addition amounts of solution I-11 and Z-11 used in the formation of phase (B) were each halved. As a result of analysis, it was proved that in emulsion 1-L, 45% by number of the tabular grains area were those having 5 or more dislocation lines in each corner of the grain.

Preparation of Tabular Silver Halide Emulsion 1-M

Silver halide tabular grain emulsion 1-M was prepared similarly to silver halide tabular grain emulsion 1-A of Example 1, except that solution I-11 and Z-11 used in the formation of phase (B) were replaced by solution I-12 as shown below. As a result of analysis, it was proved that in emulsion 1-M, 93% by number of the total grains was accounted for by tabular rains having 5 or more dislocation lines in each corner of the grain.

Solution I-12: aqueous solution containing 67.4 g of compound ID-110

Preparation of Tabular Silver Halide Emulsion 1-N

Silver halide tabular grain emulsion 1-N was prepared similarly to silver halide tabular grain emulsion 1-A of Example 1, except that in the preparation of seed emulsion 1, solution X-01 was replaced by solution X-03. As a result of analysis, it was proved that in tabular grain emulsion 1-N, 37% of the projected area of tabular grains was accounted for tabular grains having an aspect ratio of 12 or more and 44% by number of tabular grains being those having an adjacent edge ratio of 0.5 to 2.0.

Solution X-03: aqueous solution containing 1.15 mol/l potassium bromide and 1.10 mol/l potassium iodide Preparation of Tabular Silver Halide Emulsion 1-O Seed emulsion 3 was prepared similarly to seed emulsion 1, except that low molecular weight gelatin used in the nucleation stage was replaced by alkali-processed gelatin (having an average molecular weight of 100,000) and nucleation was performed at 30° C. Subsequently, silver halide tabular grain emulsion 1-O was prepared similarly to silver halide tabular grain emulsion 1-A of Example 1, except that seed emulsion 1 was replaced by seed emulsion 3. As a result of analysis, it was proved that in emulsion 1-O, 42% of the grain projected area was accounted for by tabular grains having an aspect ratio of 12 or more, and a mean spacing between twin planes of the tabular grains being 0.012 μm.

Preparation of Tabular Silver Halide Emulsion 1-P1

Silver halide tabular grain emulsion 1-P1 was prepared similarly to silver halide tabular grain emulsion 1-M, except that at the stage of forming phase (A), after adding 1908 ml of each of solutions S-11 and X-11, the pAg was adjusted to 7.3, and solution M-11 and remaining solutions S-11 and X-11 were added by the triple jet addition. In this case, an nozzle to add solution M-11 was arranged near a nozzle to add solution S-11.

Solution M-11: 151 ml aqueous solution containing $7.2\times10^{-5}$ mol of $K_4[Fe(CN)_6]$ Preparation of Tabular Silver Halide Emulsion 1-P2

Silver halide tabular grain emulsion 1-P2 was prepared similarly to silver halide tabular grain emulsion 1-P1except that solution M-11 was replaced by solution M-12.

Solution M-12: 151 ml aqueous solution containing $3.2\times10^{-4}$ mol of $K_4[Ru(CN)_6]$ Preparation of Tabular Silver Halide Emulsion 1-Q Silver halide tabular grain emulsion 1Q was prepared similarly to silver halide tabular grain emulsion 1-A, except that after forming phase (A), the reaction mixture was adjusted to a pH of 9.8 adding 0.468 M ammonia and aqueous potassium hydroxide solution and maintained for 10 min. and then the pH was adjusted to 5.0 with aqueous acetic acid solution. As a result of analysis, it was proved that in emulsion 1-Q, 80% by number of tabular grains had dislocation lines in the peripheral portions of the major face, the region surrounded by the dislocation lines in the major face being in a circular form and 88% of the total grain projected area being accounted for by tabular grains having an aspect ratio of 12 or more.

Preparation of Tabular Silver Halide Emulsion 1-R

Silver halide tabular grain emulsion 1-R was prepared similarly to silver halide tabular grain emulsion 1-M, except that after forming phase (B), the reaction mixture was adjusted to a pH of 9.8 adding 0.816 M ammonia and aqueous potassium hydroxide solution and maintained for 10 min. and then the pH was adjusted to 5.0 with aqueous acetic acid solution. As a result of analysis, it was proved that in emulsion 1-R, the average iodide content near the corners of tabular grains was lower than that of the surface, 80% by number of tabular grains having dislocation lines in the peripheral region of the major face, the region surrounded by the dislocation lines within the major face being in a circular form and 91% of the total grain projected area being accounted for by tabular grains having an aspect ratio of 12 or more.

Preparation of Tabular Silver Halide Emulsion 1-S

Using a manufacturing installation described in JP-A 10-339923, silver halide tabular grain emulsion 1-S was prepared similarly to silver halide tabular grain emulsion 1-M, except that after forming phase (A), the silver halide emulsion was subjected to a concentration treatment using a ultrafiltration membrane to decrease the emulsion volume to a half. Analysis of emulsion 1-S revealed that tabular rains having 5 or more dislocation lines in each of the corners of the grain accounted for 98% of the total grain projected area.

Preparation of Tabular Silver Halide Emulsion 1-T

Seed emulsion 4 was prepared similarly to seed emulsion 1, except that the solution within the reaction vessel used in the nucleation stage was replaced by 16.7 lit. of a solution containing 96.1 g of low molecular weight gelatin (having an average molecular weight of 15,000) and 13.9 g of potassium bromide. Subsequently, silver halide tabular grain emulsion 1-T was prepared similarly to silver halide tabular grain emulsion 1-A of Example 1, except that seed emulsion 1 was replaced by seed emulsion 4. Analysis of emulsion 1-T revealed that tabular grain having an aspect ratio of 12 or more accounted for 79% of the total grain projected area, a coefficient of variation of grain size being 18%.

Preparation of Tabular Silver Halide Emulsion 1-U

Using a manufacturing installation described in JP-A 10-339923, silver halide tabular grain emulsion 1-U was prepared similarly to silver halide tabular grain emulsion 1-A, provided that in parallel to addition of solutions S-11 and X-11 at the stage of forming phase (A), a concentration operation was conducted to remove a solution containing salts in an amount corresponding to the sum of both added solutions, thereby the emulsion volume was maintained constant during the phase (A) formation; and in the subsequent stage of forming phase (B) and the outermost phase, similar concentration operations were conducted. By subjecting the emulsion to such a concentration operation, the yield of emulsion 1-U was enhanced to ca. 1.4 times that of emulsion 1-A (in the case of using a reaction vessel having the same volume). Analysis of emulsion 1-U revealed that the emulsion was comprised of tabular grains having an average cube-converted size of 1.0, a coefficient of variation of grain size of 15% and an average surface iodide content of 9.2 mol %, and 86% of the total grain projected area being accounted for by tabular grains having an aspect ratio of 15 or more. It was further proved that 82% of the total grain projected area was accounted for by tabular grains having at least 5 dislocation lines in each of the corners of the grain, and 96% by number of the tabular grains being accounted for those having an adjacent edge ratio of 0.5 to 2.0. From sectional observation of the tabular grains, a mean spacing between twin planes was 0.008 $\mu$m and the ratio of grain thickness to phase (B) thickness being 3.3. Thus, it was proved that silver halide tabular grain emulsion 1-U has features similar to silver halide tabular grain emulsion 1-A.

Preparation of Tabular Silver Halide Emulsion 1-V

Silver halide tabular grain emulsion 1-V was prepared similarly to silver halide tabular grain emulsion 1-A, except that the volume of a solution contained in the reaction vessel before forming phase (A) was varied to 2 lit. Analysis of the emulsion revealed that tabular grains having an aspect ratio of 12 or more accounted for 43% of the total grain projected area and the aspect ratio was markedly decreased, as compared to silver halide tabular grain emulsion 1-A.

Preparation of Tabular Silver Halide Emulsion 1-W

Silver halide tabular grain emulsion 1-W was prepared similarly to silver halide tabular grain emulsion 1-A, except that the volume of a solution contained in the reaction vessel before forming phase (A) was varied to 30 lit. Analysis of the emulsion revealed that tabular grains having an aspect ratio of 12 or more accounted for 98% of the total grain projected area and the aspect ratio was markedly increased, as compared to silver halide tabular grain emulsion 1-A.

Preparation of Tabular Silver Halide Emulsion 1-X

Silver halide tabular grain emulsion 1-X was prepared similarly to silver halide tabular grain emulsion 1-A, except that phthalated gelatin was used as gelatin contained in the reaction vessel before forming phase (A). Analysis of emulsion 1-X revealed that the emulsion had features similar to emulsion 1-A.

Preparation of Tabular Silver Halide Emulsion 1-Y

Silver halide tabular grain emulsion 1-Y was prepared similarly to silver halide tabular grain emulsion 1-A, except that after completion of grain formation, phenylcarbamoyl-modified gelatin was further added and desalting was conducted by adjusting the pH. Analysis of emulsion 1-Y revealed that the emulsion had features similar to emulsion 1-A.

Preparation of Silver Halide Color Photographic Material, and Processing and Photographic Performance Evaluation Thereof Using each of the thus prepared silver halide tabular grain emulsions 1-L through 1-Y, photographic color materials 1-L through 1-Y were prepared similarly to Example 1. Samples were exposed, processed and evaluated with respect to fog density, sensitivity and graininess similarly to Example 1, the results of which are shown in Table 8. Fog density, sensitivity and graininess were represented by a relative value, based on the value of Sample 1-E of Example 1 being 100. Values of Sample 1-A are also shown in the Table.

TABLE 8

| | Sample Unexposed to Radiation | | | |
|---|---|---|---|---|
| Sample No. | Fog | Sensitivity | RMS | Remark |
| 1-E | 100 | 100 | 100 | Comp. |
| 1-A | 88 | 115 | 85 | Inv. |
| 1-L | 96 | 106 | 93 | Inv. |
| 1-M | 83 | 119 | 84 | Inv. |
| 1-N | 104 | 85 | 110 | Comp. |
| 1-O | 105 | 88 | 113 | Comp. |
| 1-P1 | 85 | 123 | 85 | Inv. |
| 1-P2 | 84 | 125 | 85 | Inv. |
| 1-Q | 80 | 114 | 77 | Inv. |
| 1-R | 81 | 122 | 80 | Inv. |
| 1-S | 80 | 127 | 79 | Inv. |
| 1-T | 92 | 108 | 88 | Inv. |
| 1-U | 88 | 116 | 84 | Inv. |
| 1-V | 95 | 91 | 92 | Comp. |
| 1-W | 87 | 120 | 85 | Inv. |

As can be seen from comparison of Samples 1-A, 1-L, 1-M and 1-S in Table 8, it was proved that the higher percentage of the grain projected area accounted for by tabular grains having at least 5 dislocation lines in respective corners of the grain achieved superior performance. It was proved that the use of the compound of formula (I), containing an iodide ion-releasing group or introduction of a concentration operation by ultrafiltration in the process of emulsion making is effective to enhance the percentage of the projected area of such tabular grains.

From comparison of analysis results of emulsions 1-A and 1-N with evaluation results of photographic material Samples 1-A and 1-N, it was suggested that when tabular grains having an adjacent edge ratio of 0.5 to 2.0 were less than 50% by number, effects of the invention were rarely displayed. From comparison of analysis results of emulsions 1-A and 1-O with evaluation results of photographic material Samples 1-A and 1-O, it was suggested that when low molecular weight gelatin was not used at the nucleation stage or the nucleation temperature was higher than 30° C., preparation of tabular grains having a mean spacing between twin planes of not more than 0.01 μm became infeasible, making it difficult to prepare silver halide tabular grain emulsions of the invention or display effects of the invention.

Comparison of Samples 1-A, 1-M, 1-P1 and 1-P2 revealed that Incorporation of the compound of formula (II) into the silver halide tabular grain emulsion of the invention achieved superior performance.

From comparison of analysis results of emulsions 1-A and 1-Q with evaluation results of photographic material Samples 1-A and 1-Q, it was proved that when at least 50% by number was accounted for by tabular grains containing dislocation lines in the peripheral region, and when the region surrounded by the dislocation lines in the major face was in a circular form, further enhanced performance was achieved.

From comparison of analysis results of emulsions 1-A and 1-R with evaluation results of photographic material Samples 1-A and 1-R, it was proved that when the average iodide content in the vicinity of the corners of the tabular grains was less than the average surface iodide content, further enhanced performance was achieved.

From comparison of analysis results of emulsions 1-A and 1-T with evaluation results of photographic material Samples 1-A and 1-T, it was proved that when the silver ion concentration within the reaction vessel was not more than $1\times10^{-2}$ mol/l at the time nucleation was completed, preparation of silver halide emulsions having features of the invention at a higher level became easier, concurrently enhancing intended performance levels of the invention.

From comparison of analysis results of emulsions 1-A and 1-U with evaluation results of photographic material Samples 1-A and 1-U, it was proved that introduction of a concentration operation by using an ultrafiltration membrane achieved enhanced yields, without adversely affecting characteristics of the silver halide emulsion or photographic performance of the photographic material by the use thereof.

From comparison of evaluation results of emulsion 1-A with those of emulsions 1-V and 1-W, it was proved that in the preparation of silver halide emulsion relating to the invention, setting an aqueous solution containing a seed emulsion at a silver ion concentration of $5\times10^{-4}$ to $5\times10^{-2}$ mol/l (preferably $1\times10^{-3}$ to $1\times10^{-2}$ mol/l) before starting the grain growth process enabled preparation of a silver halide tabular grain emulsion having a relatively high aspect ratio, thereby achieving further enhanced photographic performance.

Further, with regard to variation in fog density before and after exposure to radiation, it was proved that samples, using inventive emulsions prepared in Example 2 exhibited superior radiation resistance, similarly to Example 1. It was also shown that Samples 1-X and 1-Y exhibited sensitivity, fog and graininess at substantially the same levels as Sample 1-A and higher contrast and color maximum density than Sample 1-A.

What is claimed is:

1. A silver halide emulsion comprising a dispersing medium and tabular silver halide grains having an average iodide content of 3 to 15 mol % and comprising silver halide phases, at least 50% of the total projected area of the tabular silver halide grains being accounted for by grains having an aspect ratio of not less than 12, wherein a first of the silver halide phases is a phase (A) having an average iodide content of not more than 3 mol % and accounting for 50 to 85% of total silver, a second of the silver halide phases is a phase (B) locating outside the phase (A), having an average iodide content of 8 to 25 mol % and accounting for 10 to 35% of total silver, and a third of the silver phases is an outermost phase having an average iodide content of not more than 4 mol % and accounting for 0.5 to 15% of total silver.

2. The silver halide emulsion of claim 1, wherein at least 50% by number of the tabular silver halide grains exhibit an adjacent edge ratio of 0.5 to 2.0.

3. The silver halide emulsion of claim 1, wherein at least 50% by number of the tabular silver halide grains have at least 5 dislocation lines in each of edges of major faces.

4. The silver halide emulsion of claim 1, wherein the tabular grains exhibit a ratio of grain thickness to a thickness of the phase (B) of less than 5.

5. The silver halide emulsion of claim 1, wherein the tabular grains have an average surface iodide content of 6 to 14 mol % and a mean spacing between twin planes of not more than 0.01 μm.

6. The silver halide emulsion of claim 1, wherein the tabular grains have an average iodide content in the vicinity of corners which is less than an average surface iodide content.

7. The silver halide emulsion of claim 1, wherein at least 50% by number of the tabular grains have dislocation lines in the peripheral region of major faces and the region surrounded by the dislocation lines is in a circular form.

8. The silver halide emulsion of claim 1, wherein at least one of said phase (A), phase (B) and outermost phase contains a compound represented by the formula (II):

formula (II)

$$[ML_6]^n$$

wherein M represents a filled frontier orbital polyvalent metal ion; L represents a ligand; and n represents 1-, 2-, 3- or 4-.

9. The silver halide emulsion of claim 1, wherein at least 10% by weight of the dispersing medium is chemically modified gelatin.

10. The silver halide emulsion of claim if wherein the tabular grains exhibit a coefficient of variation of grain size of not more than 25%.

11. The silver halide emulsion of claim 1, wherein the tabular grains are substantially comprised of silver iodobromide.

* * * * *